United States Patent [19]

Hailey

[11] Patent Number: 4,689,008

[45] Date of Patent: Aug. 25, 1987

[54] HEATING AND HANDLING SYSTEM FOR METAL CONSOLIDATION PROCESS

[76] Inventor: Robert W. Hailey, 2030-229 Beverly Plz., Long Beach, Calif. 90815

[21] Appl. No.: 894,024

[22] Filed: Aug. 7, 1986

Related U.S. Application Data

[62] Division of Ser. No. 710,541, Mar. 11, 1985, Pat. No. 4,634,375.

[51] Int. Cl.[4] ..... F27B 9/00; F27D 5/00

[52] U.S. Cl. ..... 432/121; 432/122; 432/241; 419/48; 419/49

[58] Field of Search ..... 419/48, 49; 219/388; 432/122, 121, 241

[56] References Cited

U.S. PATENT DOCUMENTS

| | | | |
|---|---|---|---|
| 248,801 | 10/1881 | Sebillot . | |
| 490,451 | 1/1893 | Nau . | |
| 631,414 | 8/1899 | Anker . | |
| 1,362,296 | 12/1920 | Hagan et al. . | |
| 2,499,926 | 3/1950 | Lloyd . | |
| 2,507,274 | 5/1950 | Sevenich . | |
| 2,680,011 | 6/1954 | Holcroft . | |
| 2,899,189 | 8/1959 | Matis et al. . | |
| 2,980,412 | 4/1961 | Koerner . | |
| 3,667,746 | 6/1972 | Makarov et al. . | |
| 3,689,259 | 5/1984 | Moritski et al. | 419/49 |
| 3,747,908 | 7/1973 | Anderson . | |
| 3,836,325 | 9/1974 | Nakamura et al. | 432/241 |
| 3,867,093 | 2/1975 | Huttermann | 432/241 |
| 3,971,875 | 7/1976 | Regalbuto | 432/241 |
| 4,448,747 | 9/1972 | Hailey | 419/48 |
| 4,508,960 | 4/1985 | Arai | 219/388 |
| 4,510,363 | 4/1985 | Reynolds, Jr. | 219/388 |
| 4,610,628 | 9/1986 | Mizushina | 432/241 |

*Primary Examiner*—Henry C. Yuen

*Attorney, Agent, or Firm*—William W. Haefliger

[57] ABSTRACT

Apparatus is provided for heating powder material charges to high temperatures at a fast rate, and for moving the charges through process operations, and for maintaining the temperatures of preheated charges and protecting the charges against contamination as they are moved through process operations. Such apparatus includes: a charge enclosing heated enclosure body having two or more separate sections; an internal wall in the enclosure body sections that has an internal cavity having a configuration shaped to hold a desired charge configuration; heating means for the internal cavity wall to heat it to desired temperature; the body being openable to receive a charge or allow transfer to a next step; the body being closable to enclose the charge; the body sections being movable horizontally and vertically as required to move the charge and carry out process operations; an internal protective atmosphere around the charge; the body having associated interior insulation to reduce heat loss to the outside surfaces and allow close temperature control; and mechanisms to open and close and move the heated body sections to allow receiving, holding and transferring of the charge.

3 Claims, 38 Drawing Figures

2D
1D
1C
2C
3C
4C
1B
2B
3B
4B
1A
2A
1.5B
4.5B
2
3
4
8
9
89
55
46
50
61
152
54
157
71b'
90b'
79c'
79b'
85a'
79a'
79d'
86
87
90'
71b
42
79c
79b
30
27a
28
70
27
79d
79a
96
97
90
67
68
69
44

(1D)
(4C)
(2C)
(4B)
(2B)

6
9'
10'
14'
13'
11a'
12'
11'
10
9
13
12
8a
11a
11
1A
2A
14
65
2B
64
63
7
8b
65'
63'
71b
83
64'
8C
8d
85a''
1B/4B
1C'
86
152
61
54
46
46
50
50a
2D
1D
7
1C
3C
4C
71b'
83'
2C
103
55
89
6

71a'
28a''
71b'
71a
67
68
8a
104
103
20a''
69
85a''
28c''
10'
103
104
9'
85b''
66'
71c'
71b
20b''
99
13'
100
8d
82'
71c
82
83
66
83'
8C
8b
101
(2C)
(1B/4B)
(2A)

(4B)

(2C)

79'
117'
117
84
115
41c'
41b'
116
115'

41b'
79'
41c'
117
117'
116
84
115
115'

88
79'
117
117'
119
120
41c'
41b'

41b'
120
41c'
88
119
117
117'
79'

79'
123
125
124
117
117'
123
124
125
41c'
41b'

41b'
79'
123
41c'
124
117
117'
125
123
124

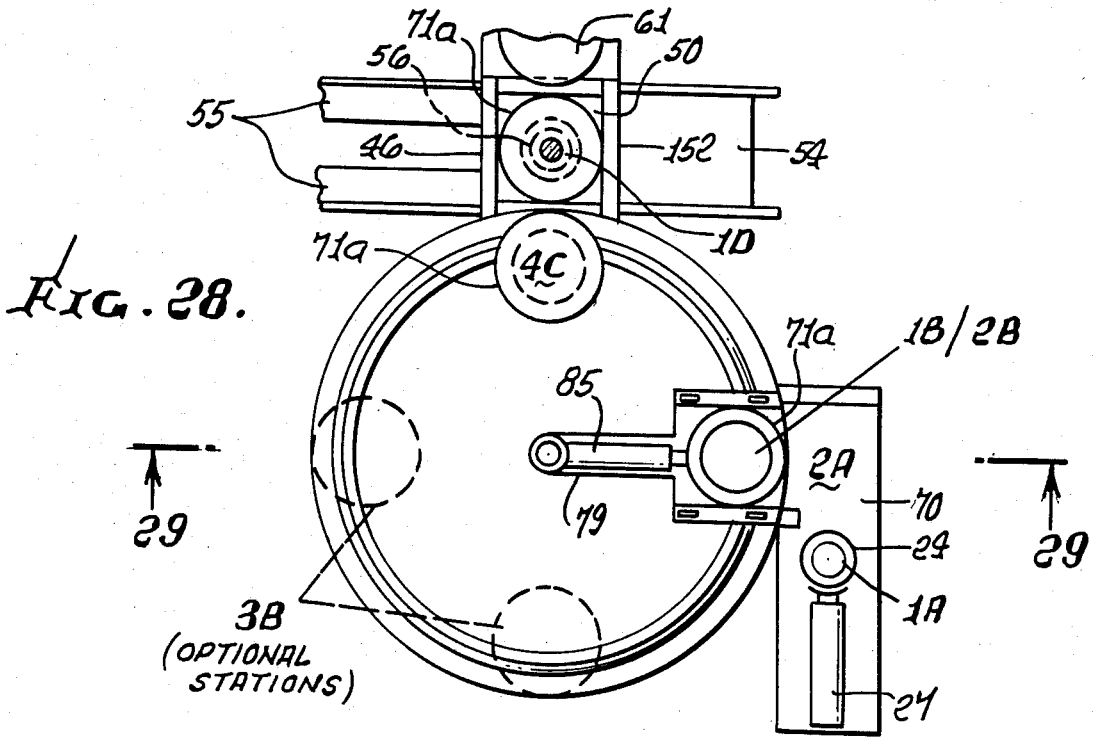
FIG. 28.
FIG. 29.
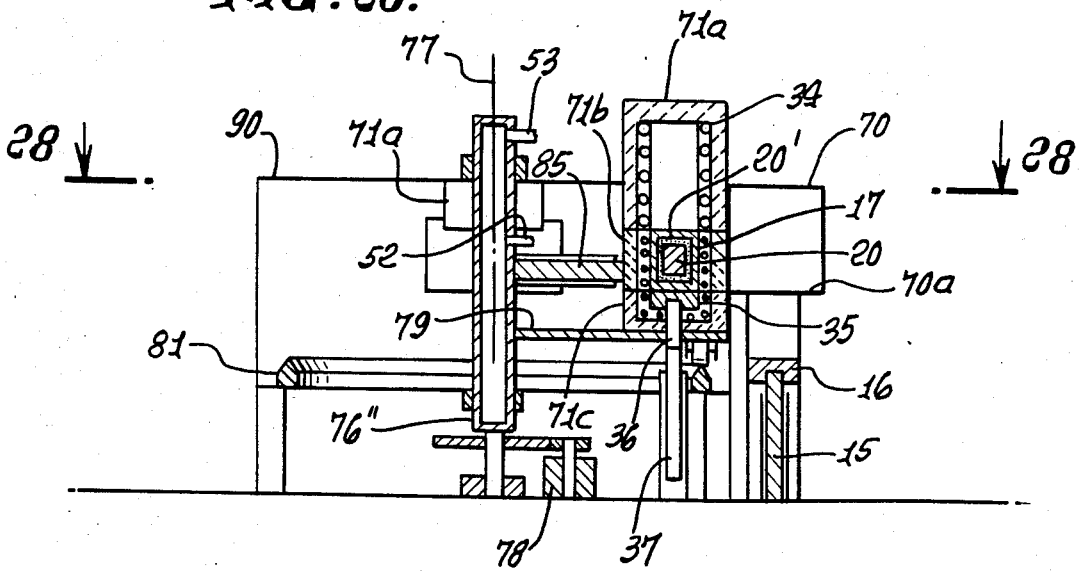

HEATING AND HANDLING SYSTEM FOR METAL CONSOLIDATION PROCESS

This is a division of application Ser. No. 710,541, filed Mar. 11, 1985, now U.S. Pat. No. 4,634,375.

BACKGROUND OF THE INVENTION

This invention relates generally to furnaces for handling hot powder material preforms and hot refractory grain. More particularly it concerns far-reaching improvements in such furnaces enabling them to operate more efficiently, with much higher production rates, in consolidating the powder material parts surrounded by the pressurized grain to full density, to controlled shape or shapes, and with desired physical properties.

Specific needs and requirements of consolidation processes that conventional furnaces cannot meet, or have substantial difficulty in meeting, includes the following:

(1) Providing an assured very high purity atmosphere through all operation steps, including tranfers between steps, to prevent oxidation or other gas contamination of the powder preforms that can damage final product purity and properties;

(2) Providing an assured close control over product temperatures through the various consolidation process steps, to obtain consistent full densities and properties in the final consolidated products;

(3) Providing highly compact design of heating and transfer system for minimum space requirements, and at minimum cost;

(4) Providing a system with highly reliable handling and transfer of products and materials through process steps requiring close process control;

(5) Providing high operating efficiences in terms of:

(a) Energy use—for heating, cooling, material recycling and process actuation;

(b) Gas atmosphere use—for minimum use of gas and/or minimum contamination thereof;

(c) Start-up and shut-down times—can be held to a minimum, usually measured in minutes;

(d) Heat transfer to product—fast through close proximity of transfer surfaces;

(6) Providing convenient, fast transfer of products through all process steps;

(7) Providing for continual processing of products and materials through sequential steps, which is particularly useful with smaller products; or for processing single product at a time through process steps, which may be advantageous with larger products;

(8) Providing repetitive precision control over product orientation and position through all process steps and with a wide range of product sizes and shapes;

(9) Providing the capability for effectively handling products ranging in size from less than a pound up to thousands of pounds, in a variety of shapes.

Prior standard or conventional furnaces designs were incapable of meeting the above requirements, and were not economically adapted to meeting high volume production heating and handling needs in metal powder consolidation processes. In particular, they did not provide the following improvements characterized by applicant's method and apparatus:

(1) Equipment and operations that are low in cost relative to competitive technology, are compact in design, and reliable in function;

(2) Efficient overall production capability that provides for handling an extensive range of product sizes, shapes and materials not possible before;

(3) An assured high level of product quality in terms of purity, properties and shape control;

(4) Flexibility for either continual or single product processing;

(5) Fast and efficient heating of charge materials while maintaining high purity protective atmospheres around the charge materials and in the furnace system.

SUMMARY OF THE INVENTION

It is a major object of the invention to provide method and means for overcoming the above disadvantages and problems, and enabling increased rates of production of high quality consolidated powder material products, at low cost. Basically, apparatus incorporating the invention enables heating of metal or ceramic or refractory charges to high temperatures at fast rates, or of maintaining the temperatures of preheated charges, while protecting the charges against contamination, and providing practical means for transferring charge materials through process steps, and includes: a heated enclosure body for enclosing charges, having two or more separable sections; an internal cavity configuration shaped to hold a desired charge configuration; heating means associated with an internal cavity surface to maintain the internal surface and the charge at a desired temperature; the body being openable to receive a charge or allow transfer to a next step; the body being closable to enclose the charge; an internal protective atmosphere around the charge; the body having associated interior insulation to reduce heat loss to the outside surfaces and allow close temperature control; and mechanisms to open and close and move the heated body to allow receiving, holding and transferring of the charge materials.

As will appear, the top section of the heated enclosure body may be held in a fixed position and adapted either to carry out a processing operation or to maintain the top of the charge at a desired temperature; the lower separable section or sections of the heated enclosure body being movable through operational steps that allow the charge to be received, processed and transferred as required, while protecting the charge against atmospheric or other contamination; and adapted for required control of charge temperatures, and for maintaining the charge in a desired orientation. Further, the top section or sections of the heated enclosure body may be movable to open and close the heated enclosure body for processing the charge, with means for so moving said top section or sections. Further, each separable section of the heated enclosure body typically has its own container shell which carries insulation; an internal cavity wall that is heated by heating means; and other internal parts of the section; provides for feeding services such as gas, electricity and water to the internal parts of the section through gas-tight seals and lines; provides mating surfaces and alignment means with adjoining sections; holds internal parts of the section in a stable configuration; provides for precise positioning of the body section in each of multiple process steps; and provides a close enough fit with an adjoining section or sections to maintain a high purity atmosphere inside the internal cavity, and to minimize heat loss from the internal cavity.

The heated enclosure body sections are preferably in container shells which are enclosed in an outer chamber which is gas tight and contains essentially the same atmosphere as that within the heated enclosure body; and the outer chamber is constructed to allow the body sections to be moved through process steps inside the outer chamber with minimum or no exposure to external air. Electrical resistance heating elements associated with the internal cavity walls together with insulation around the heating elements provide good electrical insulation and also good heat transfer from the elements to the internal cavity surfaces, particularly when the insulated elements are fitted snugly in grooves in the back of the internal cavity walls or are embedded as by powder metallurgy methods such as consolidation in the wall back of the internal cavity surfaces. The internal cavity walls may consist of metal or ceramic, and the heating elements may be resistance heating elements or also may be induction heating coils.

Charge materials may be raised or lowered or otherwise moved into place in the heated enclosure body by properly positioning the top, middle and lower sections of the body for a loading step, and moving the charge materials into place. Charge materials may be discharged from the heated enclosure body by properly positioning the top, middle, and lower sections of the body for unloading, and raising or lowering or otherwise moving the charge materials to discharge them.

Lower sections of the heated enclosure body typically can be made movable in a rotary path within an outer chamber, by being connected to and rotating with a central shaft provided in the outer chamber, which has a gas tight seal to the bottom and/or top or the outer chamber. The shaft can be made to rotate continually in one direction to carry the lower sections continually through sequential steps of a process, or it can be made to rotate back to a starting position after it has rotated continually through a set of sequential steps that normally take less than 360° of the rotary path, to start through the sequential steps again. Lower sections of the enclosure body are supported on radial arms which are connected to and rotate with the central shaft to locate the lower sections precisely at sequential processing stations around the central shaft. The central shaft is typically hollow and has its inner end closed, and service lines required by the lower sections enter the outer chamber through the shaft but through seals that prevent air or other contaminants from leaking into the high purity atmosphere of the outer chamber. Radial arms supporting the lower sections are supported by wheels that run on a circular track in the outer chamber, to prevent undesirable loading of the central shaft, and the lower sections are operatively connected with a roller and track system oriented radially to provide for easy and controlled movement of the sections radially; the roller and track system operating to move the bottom section or sections radially with respect to the support arm, and the roller and track system operating to move the middle section radially relative to the bottom section. Finally, the lower sections are operatively connected with a mechanical or hydraulic device to raise or lower the track and the section supported by the track a slight amount so that the sections can be separated vertically just before they are moved horizontally, in order to allow the move to be made with minimum or no friction and wear, with each section returned to a close mating fit with the adjoining section or sections after the move is made.

As will appear, a number of top sections for the heated enclosure body are positioned in a circular path inside the top of the outer chamber and around the central shaft as required for the sequential processing steps, and a single lower section or set of lower sections is connected to the central shaft and moved through the sequential steps either continually or with a reversing cycle, or a number of lower sections may be positioned around and connected by radial arms to the central shaft, and moved through the sequential steps either continuously or with a reversing cycle. The lower sections are movable radially as well as in a circular path. In addition, two rotating and indexing systems may be provided that can be interconnected, one system to preheat the charges to required temperatures for the process, and the second to heat and load refractory grain around the hot charges, with other attached systems that provide for entering the charges that are to be heated, and for transferring the hot grain-enclosed charges to a consolidation die, in a step-by-step controlled sequence, for ultimate consolidation.

These and other objects and advantages of the invention, as well as the details of an illustrative embodiment, will be more fully understood from the following specification and drawings, in which:

DRAWING DESCRIPTION

FIG. 1 is a plan view on lines 1—1 of FIG. 2 of apparatus incorporating the invention.

FIG. 1' is a plan view on lines 1—1 of FIG. 2' of apparatus incorporating the invention.

FIG. 2 is a section elevation on lines 2—2 of FIG. 1 showing details of stations 2B and 4B.

FIG. 2' is a section elevation on lines 2—2 of FIG. 1' showing details of stations 2C and 4C.

FIG. 3 is a section elevation on lines 3—3 of FIG. 1 showing details of stations 3B, 1B and 2A.

FIG. **3*a* is a section elevation on lines 3*a*—3*a* of FIG. 3 showing details of stations 2A and 1A**.

Figure 5:
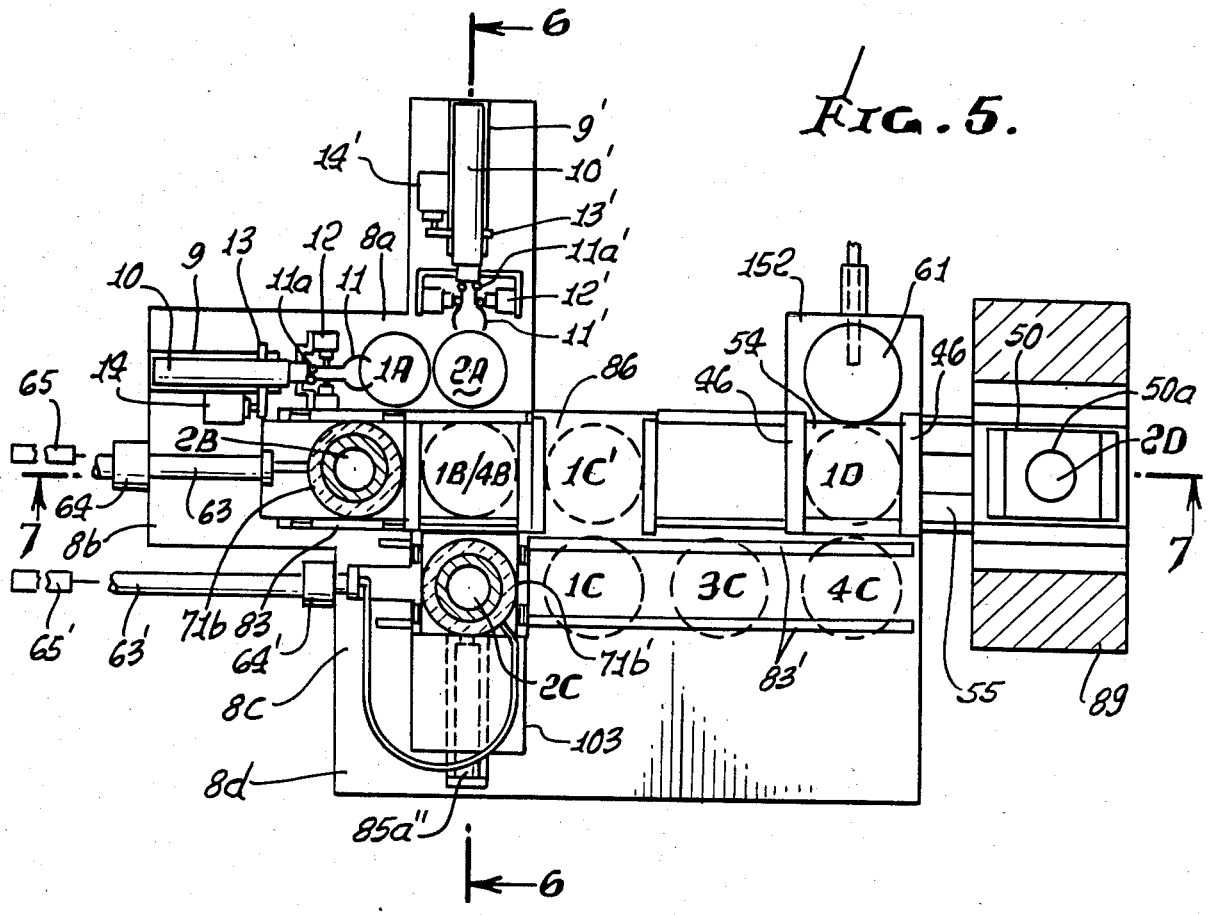
FIG. 5 is a plan view on lines 5—5 of FIG. 7 showing other form of apparatus incorporating the invention.

FIG. **6*a* is a section elevation on lines 6—6 of FIG. 5 showing a following step of transferring a heated charge from station 1B/4B to 2C**.

Figure 7:
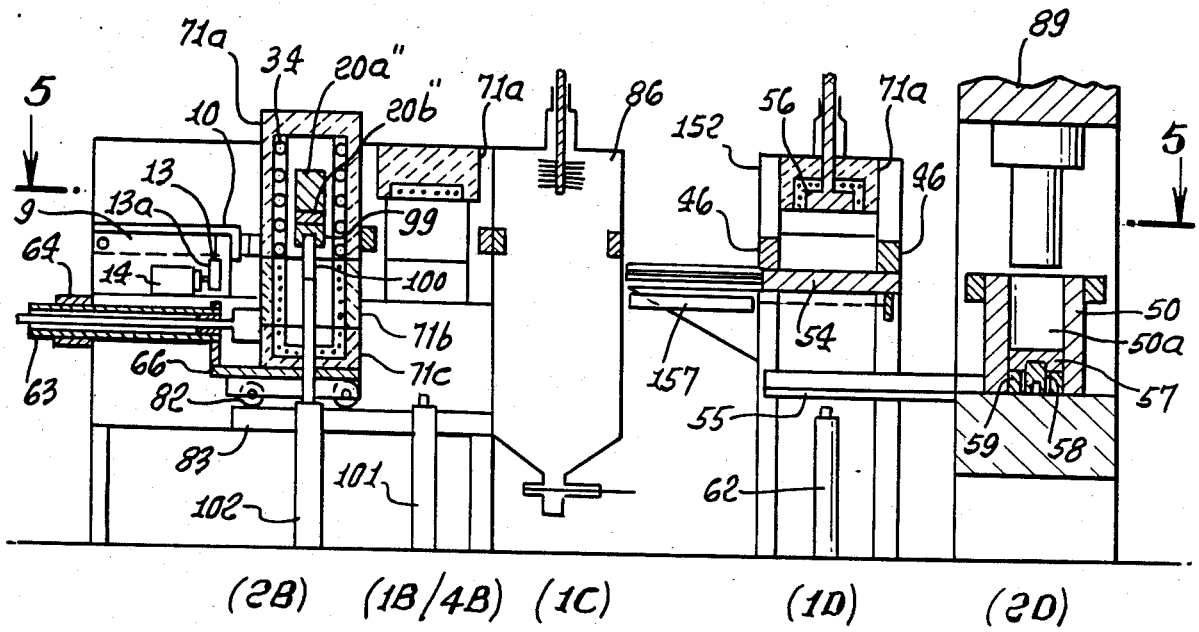

FIG. 7 is a section elevation on lines 7—7 of FIG. 5, showing a following step of heating a charge at station 2B, and details of stations 1D and 2D.

Figure 1:
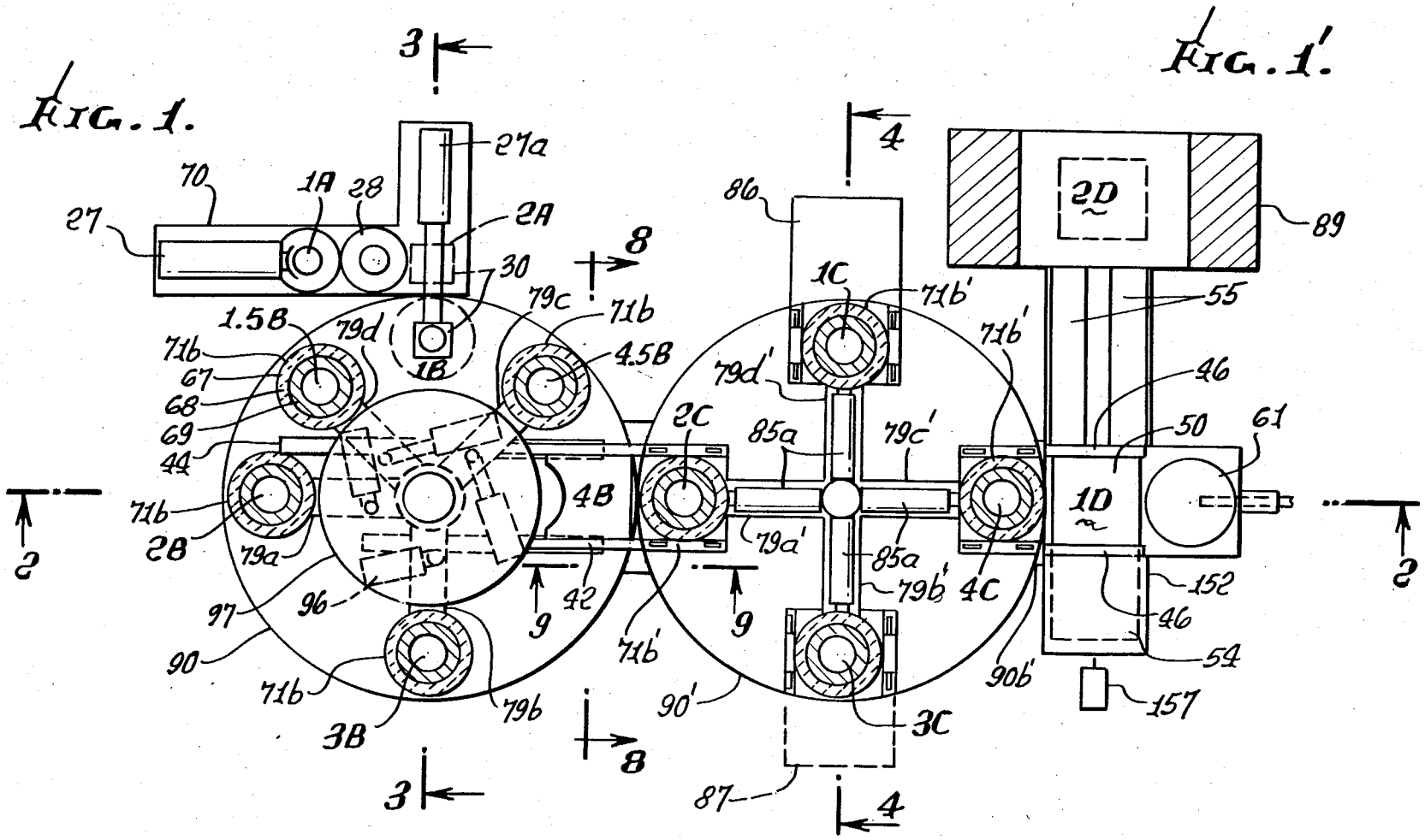
Figure 8:
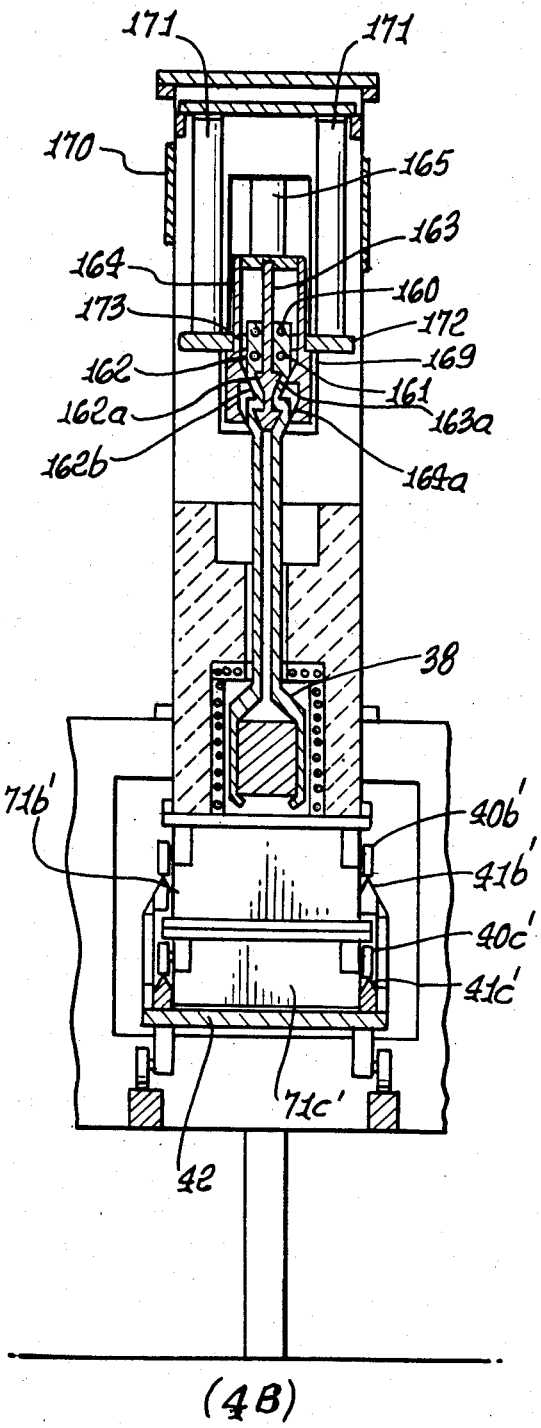

FIG. 8 is a section elevation on lines 8—8 of FIG. 1, showing details of the charge lifting mechanism, and of the roller track mechanism for a heated enclosure body.

Figure 9:
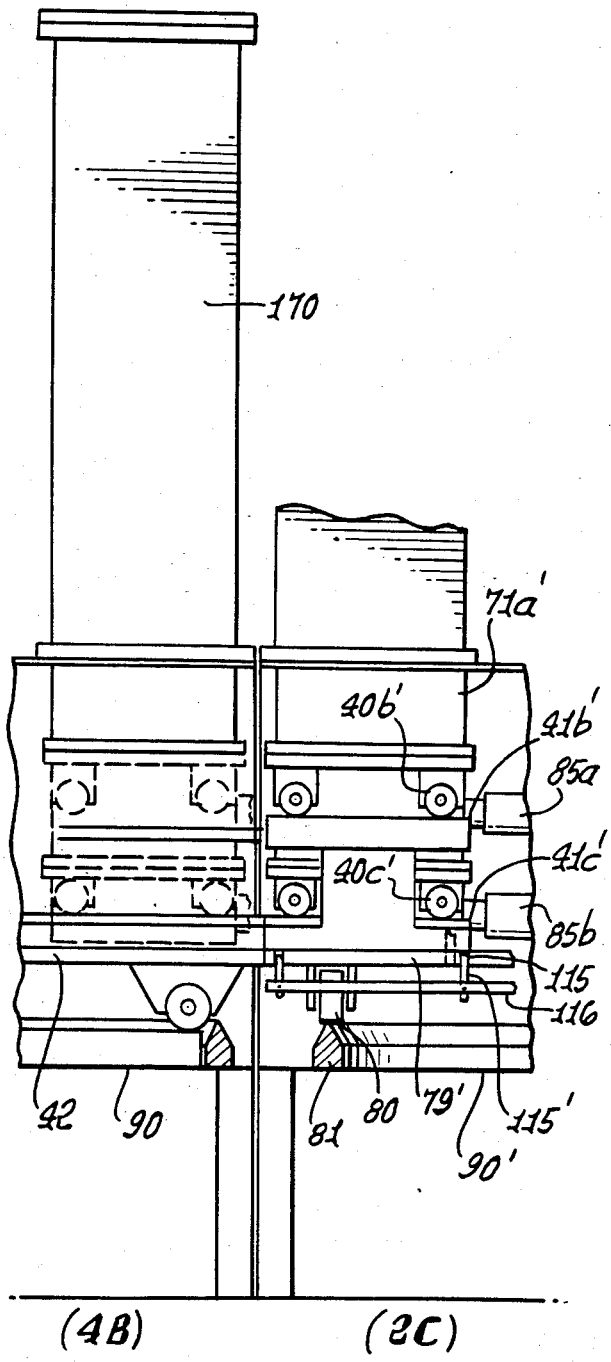

FIG. 9 is a section elevation on lines 9—9 of FIGS. 1 and 1', showing additional external details of a heated enclosure body and roller and track mechanism.

Figure 10:
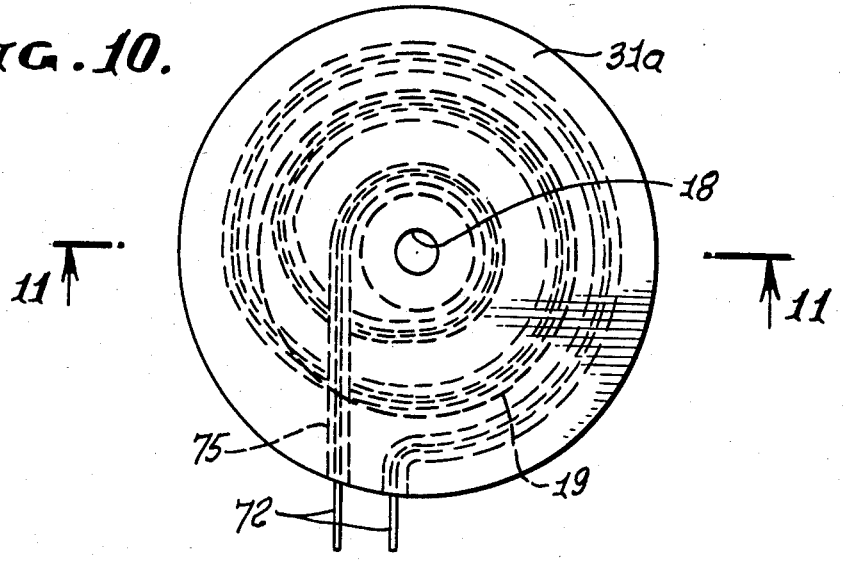

FIG. 10 is a plan view of a basic internal cavity form with embedded resistance heating elements.

Figure 11:
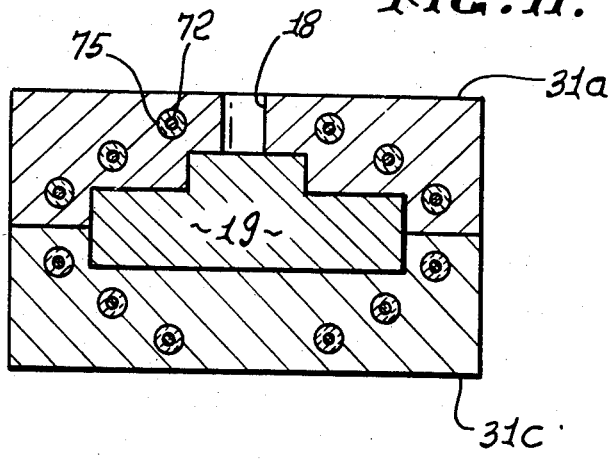

FIG. 11 is a section elevation on lines 11—11 of FIG. 10, showing details of the embedded heating elements and a form enclosed for heating.

Figure 12:
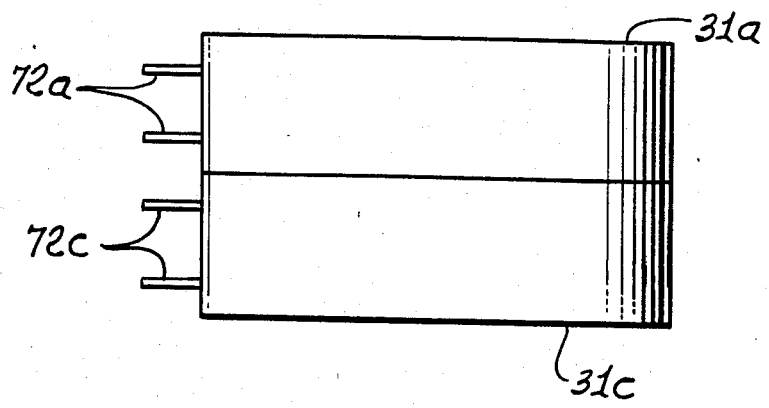

FIG. 12 is a full side elevation of FIG. 11

Figure 13:
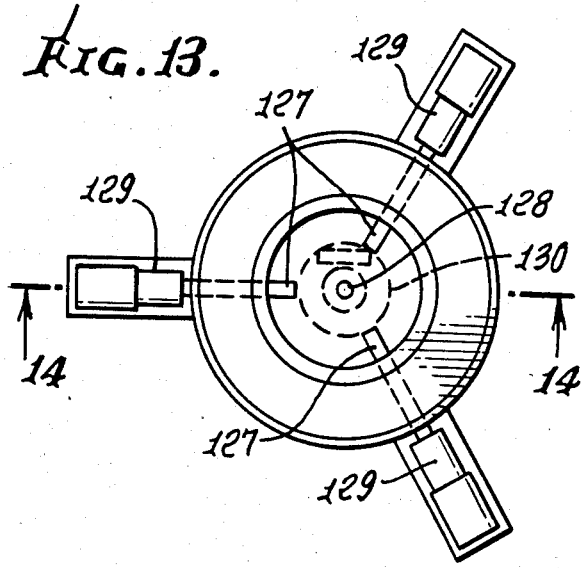

FIG. 13 is a plan view of a middle section of a heated enclosure body, showing apparatus for aligning and supporting a cylindrical charge with horizontal side rods and vertical bottom rods.

Figure 14:
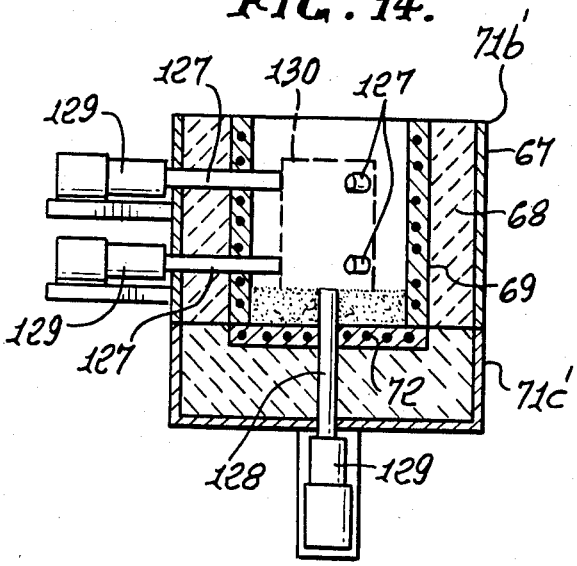

FIG. 14 is a section elevation on lines 14—14 of FIG. 13, showing the alignment rods in the position that would align and support a cylindrical charge.

Figure 15:
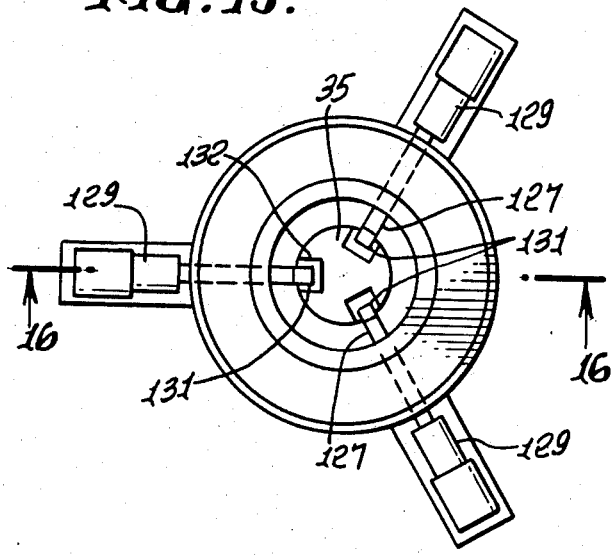

FIG. 15 is a plan view of a middle section of a heated enclosure body showing the use of horizontal side rods or bars for the support of a charge as well as alignment.

Figure 16:
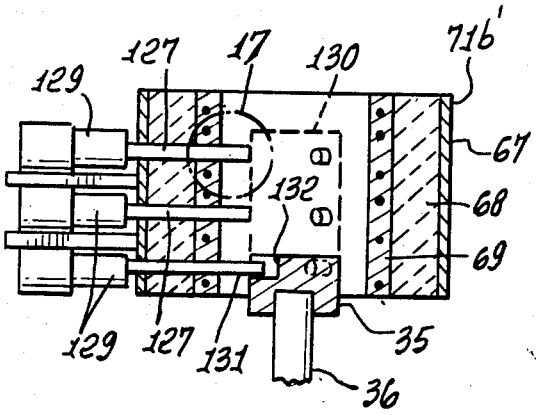

FIG. 16 is a section elevation on lines 16—16 of FIG. 15 showing the horizontal side rods in the position that would support and maintain alignment of a cylindrical charge as it is moved and enclosed in hot ceramic grain.

Figure 17:
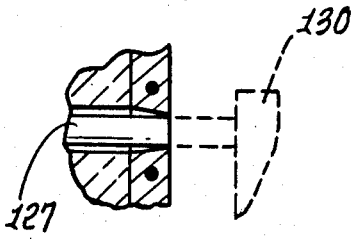

FIG. 17 is a section detail from FIG. 16 of an alignment rod withdrawn to a rest position for loading or unloading charge.

Figure 6:
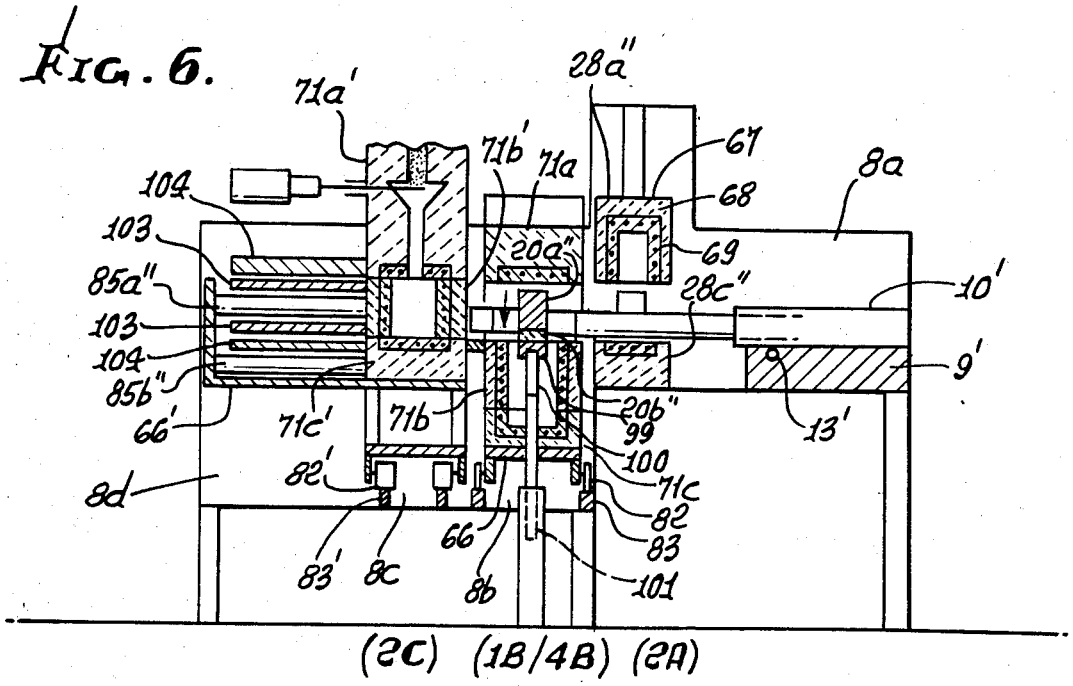
FIG. 6 is a section elevation on lines 6—6 of FIG. 5, showing a step in the loading of a charge from 2A to 1B.
Figure 6A:
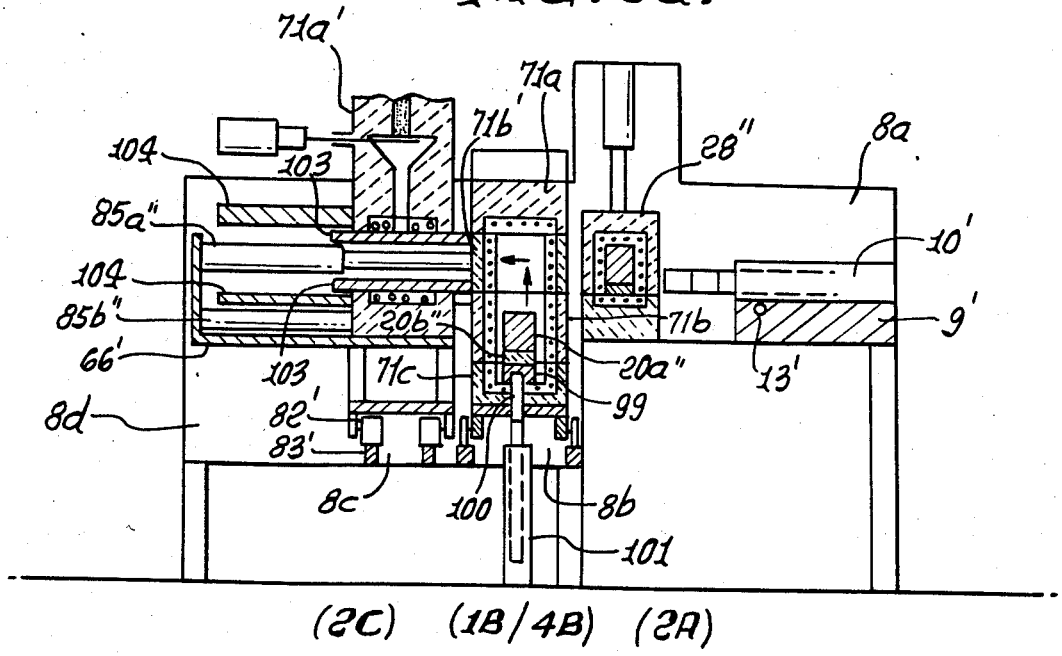
Figure 18:
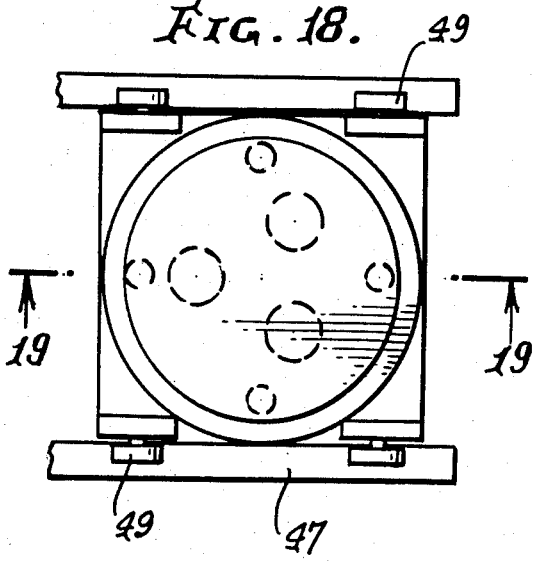

FIG. 18 is a plan view of an apparatus for aligning a charge with vertical alignment rods in the middle section of a heated enclosure body, as when the preheated charge is loaded from the bottom at position 4B as shown in FIG. 6a.

Figure 19:
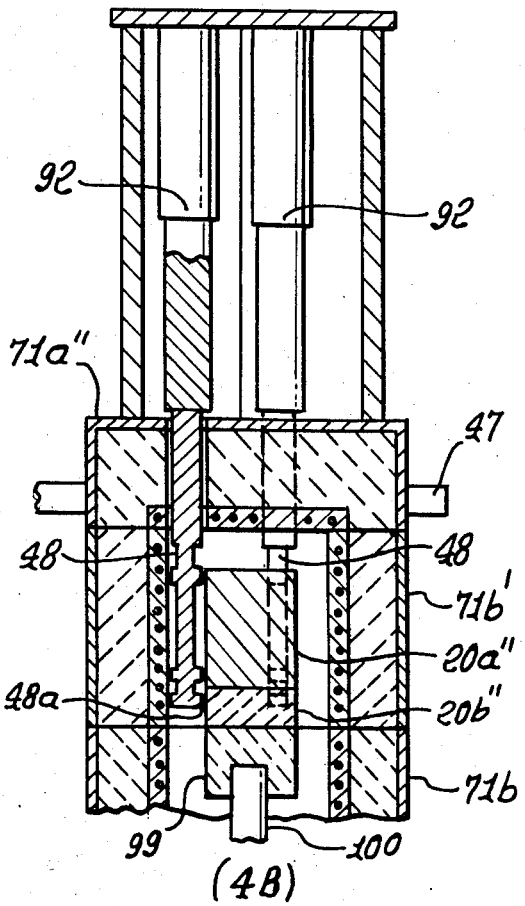

FIG. 19 is a section elevation through lines 19—19 of FIG. 18, showing the vertical alignment rods in their down position, with the charge ready to be moved horizontally from position 4B to 2C.

Figure 20:
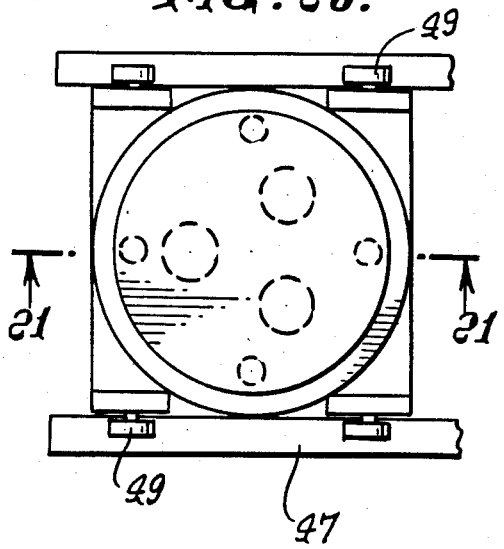

FIG. 20 is a plan view of the apparatus of FIG. 18, but moved horizontally to position 2C, with the charge held aligned during the move by the vertical alignment rods.

Figure 21:
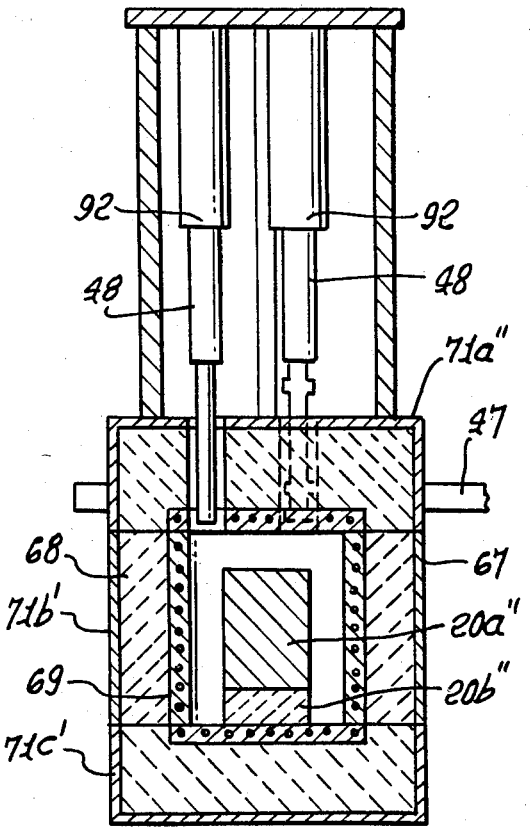

FIG. 21 is a section elevation through lines 21—21 of FIG. 20, showing the vertical alignment rods withdrawn to their up position, with the charge ready for a following hot ceramic grain loading.

Figures 22, 23, 24, 25, 26, 27:
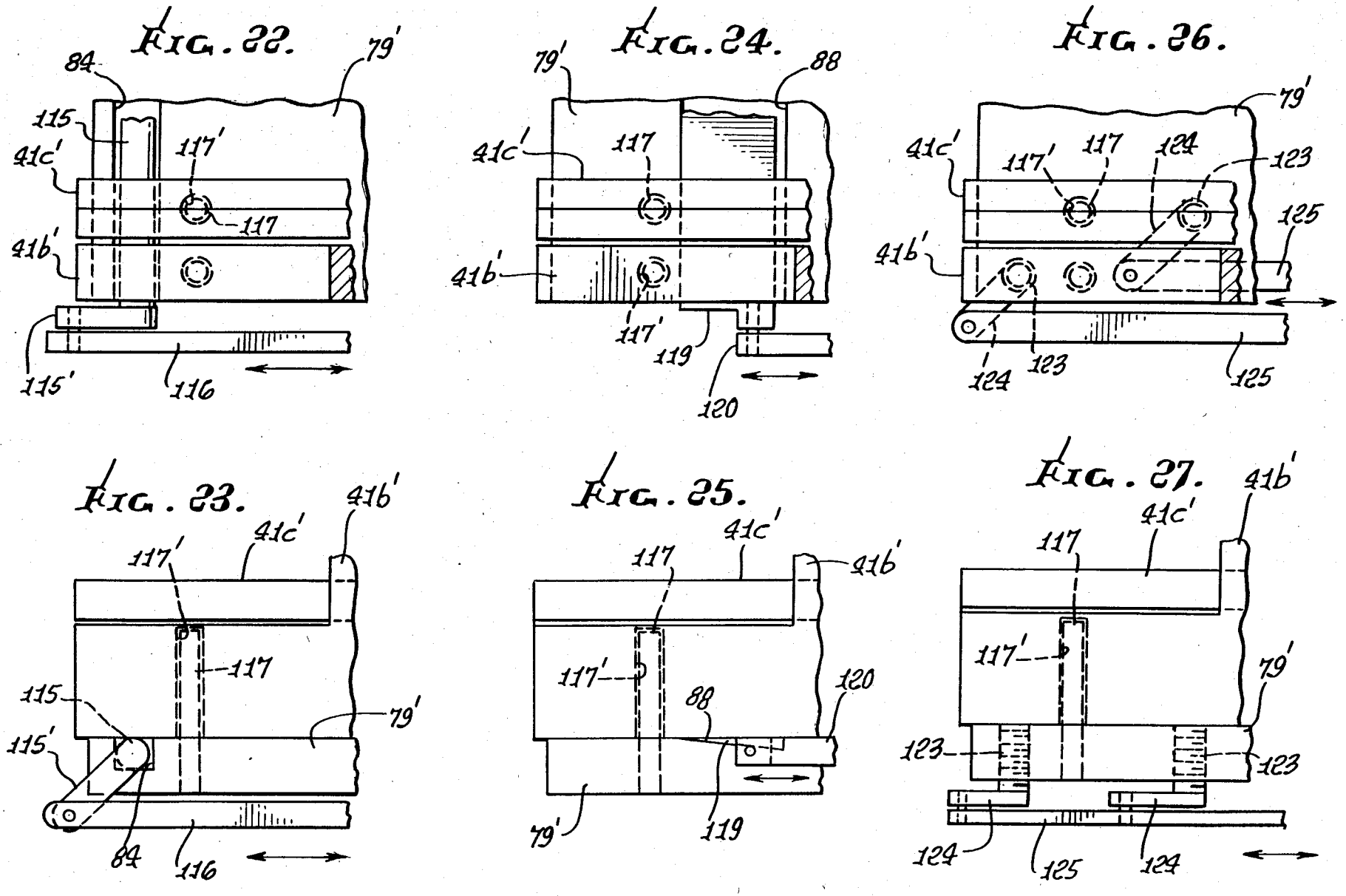

FIGS. 22 and 23 show a plan view and front elevation showing details of a cam rod lift mechanism to raise and lower the support tracks for the heated enclosure body sections such as in FIG. 9.

FIGS. 24 and 25 show a plan view and front elevation showing details of a wedge lift mechanism to raise and lower the support tracks for the heated enclosure body sections such as in FIG. 9.

FIGS. 26 and 27 show a plan view and front elevation showing details of a screw lift mechanism to raise and lower the support tracks for the heated enclosure body sections such as in FIG. 9.

FIG. 28 shows a plan view on lines 28—28 of FIG. 29 of a single circular chamber for entering and heating a charge that is already in a container, and transferring the contained charge to a die.

FIG. 29 is a section elevation through lines 29—29 of FIG. 28 showing the contained charge at station 1B/2B.

Figure 30:
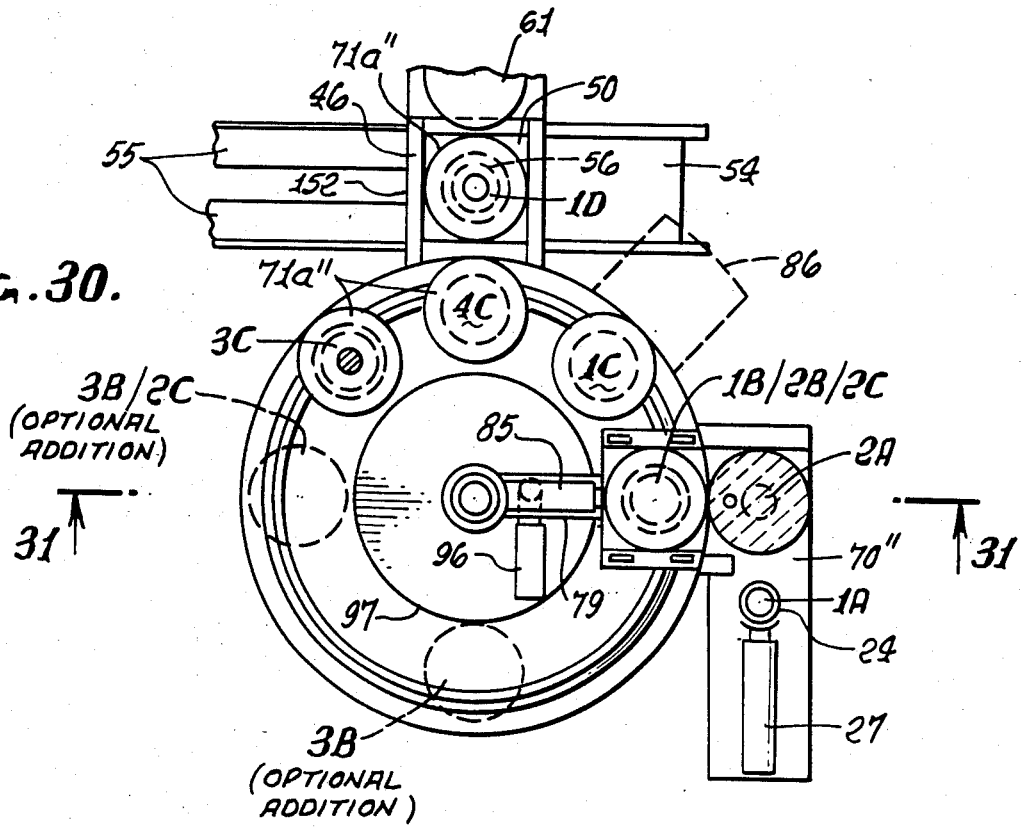
Figure 31:
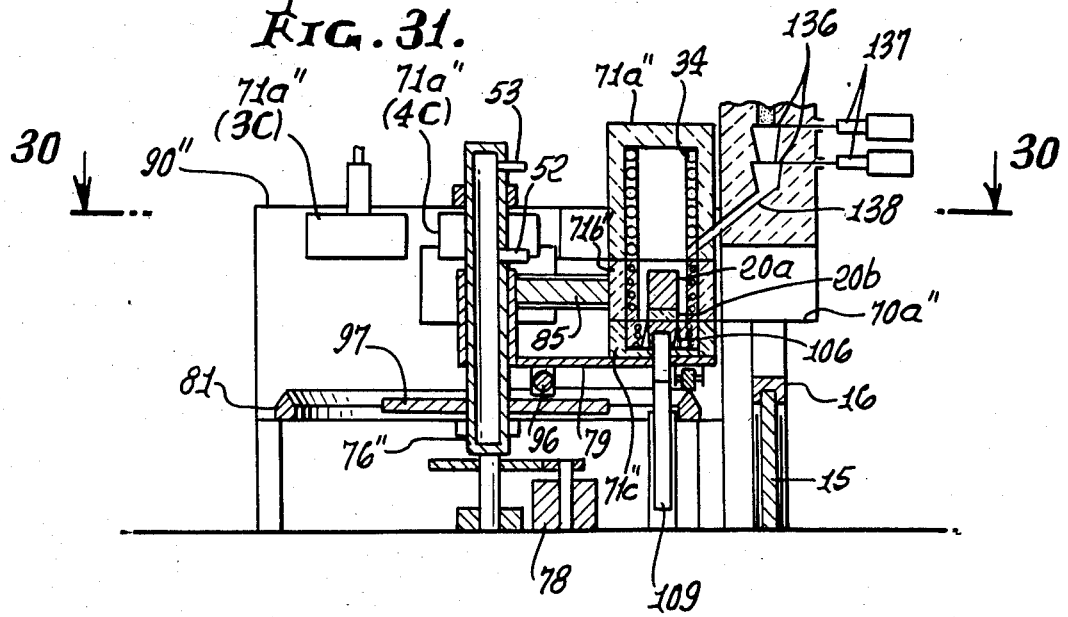

FIG. 30 shows a plan view of lines 30—30 of FIG. 31 of a single circular chamber for entering and heating a charge and enclosing it in refractory grain, and transferring the grain-enclosed charge to a die.

FIG. 31 is a section elevation on lines 31—31 of FIG. 30 showing a charge at station 1B/2B/2C.

Figure 32:
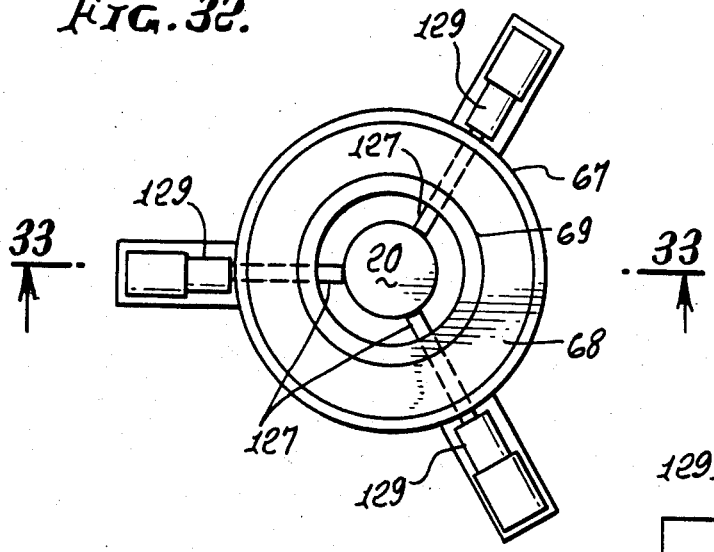

FIG. 32 is a plan view of a middle section of a heated enclosure body, showing apparatus for aligning and supporting a cylindrical charge with horizontal side rods and vertical bottom rods, especially with the single chamber operations of FIGS. 30 and 31.

Figure 33:
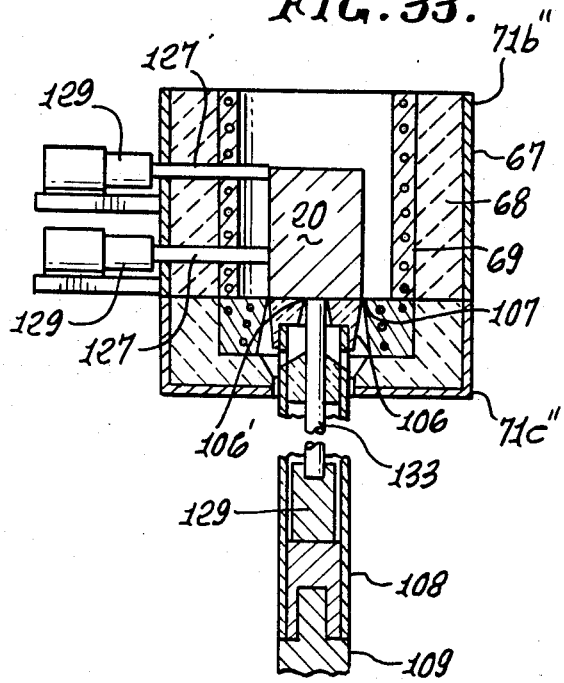

FIG. 33 is a section elevation on lines 33—33 of FIG. 32 showing the charge aligned transversely with horizontal side rods, with the vertical rod at the bottom ready to be raised to vertically align the charge.

Figure 34:
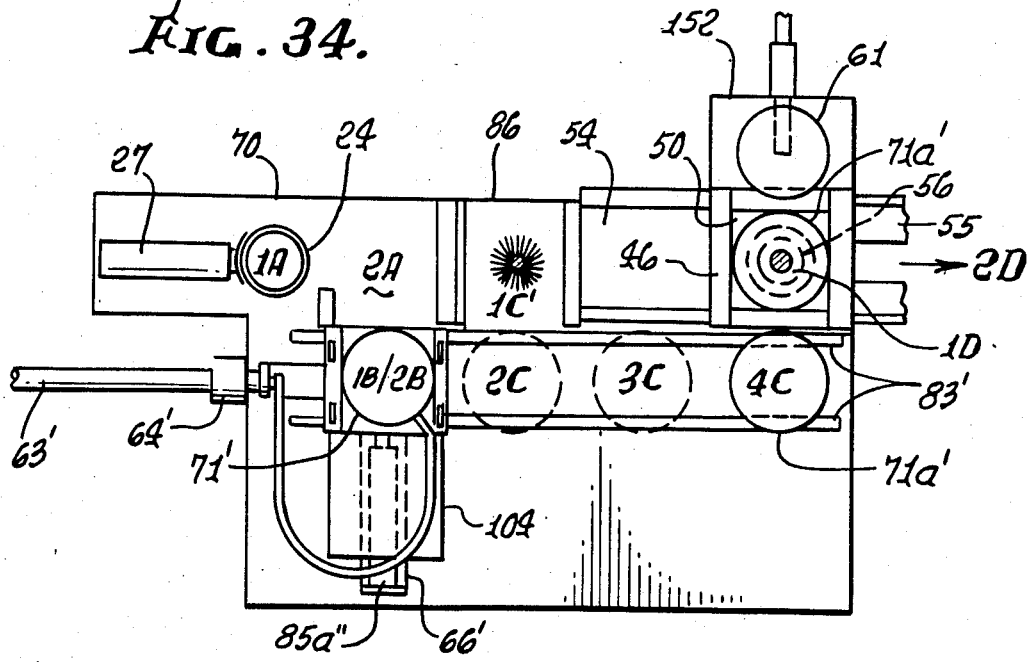

FIG. 34 is a plan view of the interior of a simplified straight line chamber for heating and transferring charges through consolidation process steps.

DETAILED DESCRIPTION

General Organization

Figure 2:
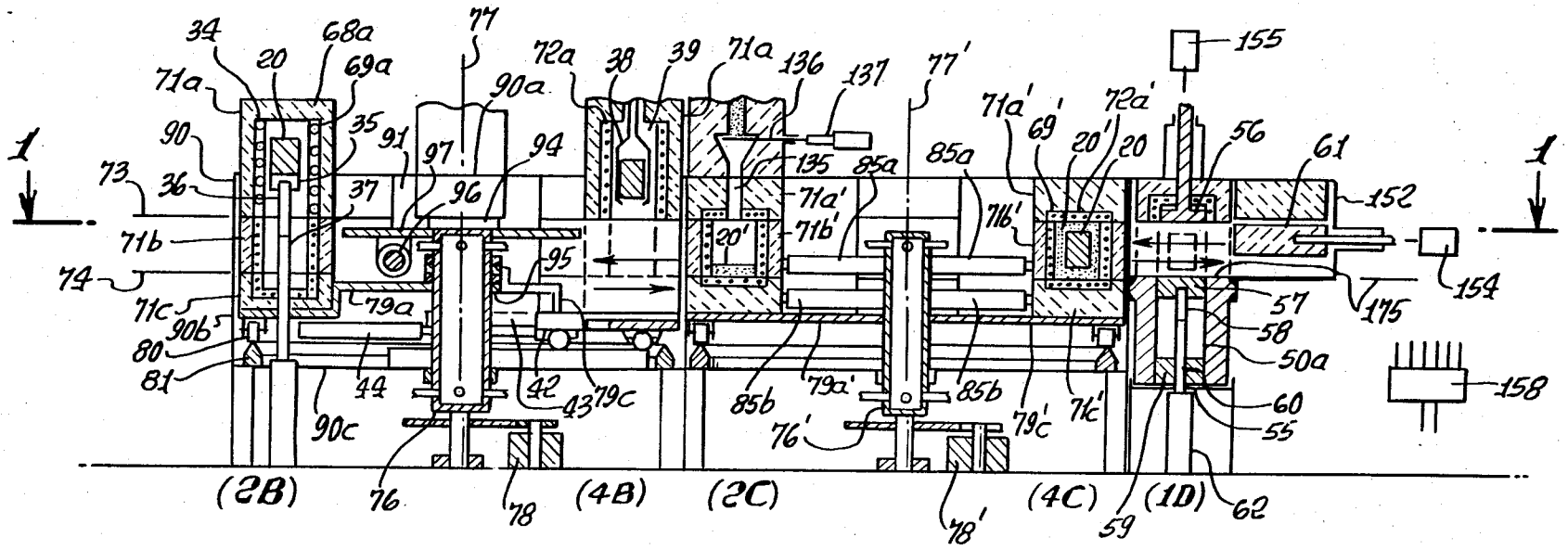

Referring first to FIGS. 1 and 2 apparatus, the charge 20 to be treated, shown as having been transferred into an entrance chamber 70, associated with station 1B, typically consists of a pressed or sintered powder preform which may have a simple or complex shape. Examples would include preformed billets of rectilinear or cylindrical configuration; tube preforms of rectilinear or cylindrical configuration; valve bodies and parts; pipe fittings such as tees, elbows and union components; tools such as wrenches and cutting tools; and other products which can be preformed from powdered materials such as aluminum, copper, iron, nickel, cobalt, titanium, niobium, molybdenum, tungsten and other metals and their alloys, as well as metal compounds such as oxides and carbides and similar ceramic and refractory materials.

The charge 20 is transferred from the entrance chamber 70 to a heated enclosure body 71 with container shell 67, insulation 68 and internal cavity walls 69, having multiple insulated sections as for example are indicated at 71a, 71b and 71c, in FIG. 2. Four such bodies are, for example, located at 90° intervals about axis 77, but the number of enclosure bodies used will depend upon production requirements, with from one to ten or more bodies being typical. Electrical heater elements which can be associated with the sections of the enclosure bodies are indicated at 72a, 72b, and 72c. The sections interfit, and are relatively shiftable, along or at horizontal planes 73 and 74. Means to travel the lower sections 71b and 71c of bodies 71 in a circular path includes, for example, a vertical central shaft 76, suitably rotated about vertical axis 77 as by a drive indicated at 78. Arms or spokes 79a, 79b, 79c and 79d project radially from the shaft and are rotated thereby. Wheels 80 under the arms travel on a circular track 81, and support the weight of the heated enclosure body sections 71b and 71c as they rotate on the arms 79a—79d under body sections 71a. Body sections 71a normally are fixed in position and do not rotate. Each of the arms 79a—79d is connected to the central shaft 76 by attachment to a ring 95 around shaft 76 which allows each arm to swivel up to about 45° from its normal position relative to the other arms. The swivelling action is shown in FIG. 1 at positions 1.5B and 4.5B, where the arms have been swivelled respectively from stations 1B and 4B. Swivelling is accomplished by extending and retracting the piston rods of rams 96, which rams are shown in FIG. 1 as attached at their base ends to a support plate 97, and are attached to their rod ends to arms 79a—79d in such a manner that they can move freely as they swivel. Support plate 97 is attached in a fixed horizontal position to the top section of shaft 76 so that the heated enclosure bodies can be precisely positioned at their normal station positions by shaft 76 when the piston rods of rams 96, as shown in this system, are retracted. The swivel action provided by the rams provides for two separate actions at a station without interference with other station operations.

An outer housing 90 encloses the apparatus in gas tight chamber or zone 91 and is indicated by walls 90a, 90b and 90c. Entrance chamber 70, with stations 1A and 2A, is associated with housing 90 and its stations 1B–4.5B, as seen in FIG. 1.

Accordingly, FIGS. 1 and 2 describe a rotary assembly in chamber 90 for receiving successive charges 20 from entrance chamber 70; and while the charges are carried by the rotary assembly, including the enclosure body lower sections 71c, they are heated and maintained at substantially high temperature by elements 72a, 72b, and 72c. Four such heated enclosure body sections 71b and 71c are shown as successively movable, rotatably, between stations 1B, 2B, 3B, and 4B, as indicated in FIG. 1. The operations carried out at stations 1A, 2A and 1B–4B may be summarized, as follows, with further reference to FIGS. 1, 2, and 3.

1A—charge loading station, wherein a powder material charge which has been pre-compressed to a desired shape and normally is not heated, is loaded into an entrance chamber indicated at 70.

2A—tray station, wherein the charge has been positioned on a tray, indicated at 30.

1B—charge loading station, wherein the charge is moved on tray 30 into the pre-heat chamber 90, and loaded into a heated enclosure body 71.

2B,3B—charge heating stations, wherein the charge is heated in the heated enclosure body to a high temperature below its melting point, typically 900°–1100° F. with aluminum alloys; 2000°–2300° F. with iron, nickel and cobalt base alloys; and up to 2500°–3200° or higher with molybdenum, tungsten and other refractory alloys and materials.

4B—transfer station wherein the heated charge is now positioned for transfer to station 2C as will be described.

FIGS. 1' and 2' also show a system which is connected to the preheat system of FIGS. 1 and 2, and which is associated with stations 1C, 2C, 3C, 4C, 1D and 2D, that provides closely controlled sequential operations through these stations to enclose the heated charges in hot refractory grain and to transfer them to a die and a press for consolidation. Rotary apparatus similar to that described and shown in FIGS. 1 and 2 is provided, with similar parts having the same numerals, but with primes, thus 76' corresponds to 76, etc. In the same manner, heated enclosure bodies 71' are provided with sections 71a', 71b', and 71c' corresponding to sections 71a–71c, the heated sections 71a' not being rotatable, but the lower sections 71b' and and 71c' at each quadrant being rotatable by arms attached to shaft 76'. Upper and lower rams 85a and 85b are associated with the radial arms 79a'–79d', and are independently operable to displace the heated enclosure body sections 71b' and 71c' radially. Typically, from two to ten or more top sections 71a' can be used in this system to carry out the required operations, along with from one to ten or more rotatable lower sections, with the lower sections 71b' and 71c' positioned by arms 79a'–79d' to interfit with top sections 71a', and with the actual numbers of top and lower sections respectively being determined by production requirements. The operations carried out at stations 1C–4C, 1D and 2D may be summarized as follows, with further reference to FIGS. 1', 2' and 4.

1C—cleaning station wherein the lower sections of the heated enclosure body are cleaned, as by wire brushing the bore of section 71b' and the top surface of section 71c' via appropriate means. To this end, section 71b' may be displaced radially outward by ram 85a to attached chamber 86, as shown schematically in FIG. 1'.

2C*—loading station wherein:

(a) hot refractory grain is loaded into the lower sections of the heated enclosure body, as will be described.

(b) the heated enclosure body sections 71b' and 71c' are moved to station 4B to receive the charge load, and then moved back to station 2C, as by operation of rams 85a and 85b.

(c) hot refractory grain is loaded over the charge to cover same, as will be explained.

*Note that hot refractory grain loading also can be accomplished at station 4B, in place of an overhead charge loading device, or by slanted chutes from an offset feed hopper, or by other means, with the grain including non-metallic materials such as silica, alumina, carbon and graphite.

Figure 4:
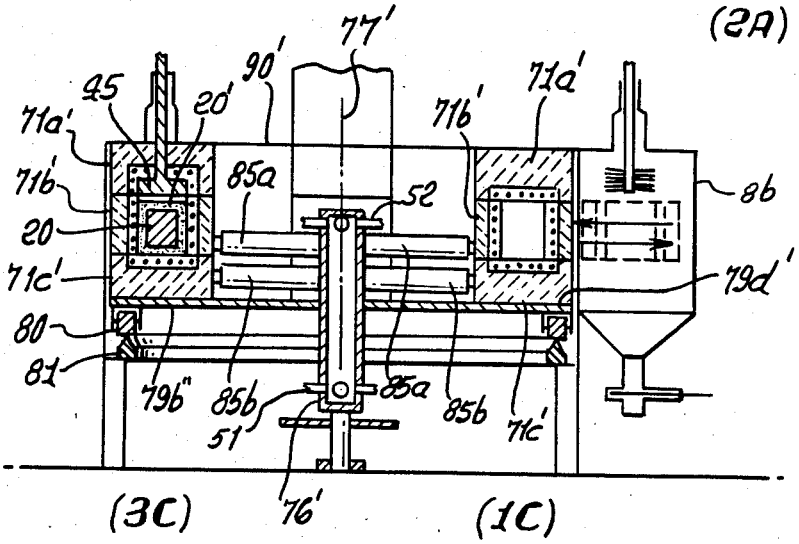
FIG. 4 is a section elevation on lines 4—4 of FIG. 1' showing details of stations 3C and 1C.

3C—packing station wherein hot refractory grain is packed, by vibratory or other appropriate means as required, as by packing ram mechanism above station 3C as shown in FIG. 4 or at location 87 as indicated schematically in FIG. 1'.

4C—transfer station wherein section 71b' of the heated enclosure body 71', containing the hot refractory grain and charge, is moved over the consolidation die 50, associated with station 1D, as will be explained.

1D—the hot refractory grain 20' and enclosed hot charge 20 are moved downwardly out from the heated enclosure body section 71b' into the consolidation die 50, as will be explained.

2D—consolidation station to which the die 50 with its enclosed hot charge and grain are moved, into a position below a punch in a press 89 for consolidation (see for example U.S. Pat. No. 3,689,259). A die transfer track is indicated at 55 in FIG. 1'.

DETAILED DESCRIPTION WITH EXAMPLES OF OPERATION

Figure 3:
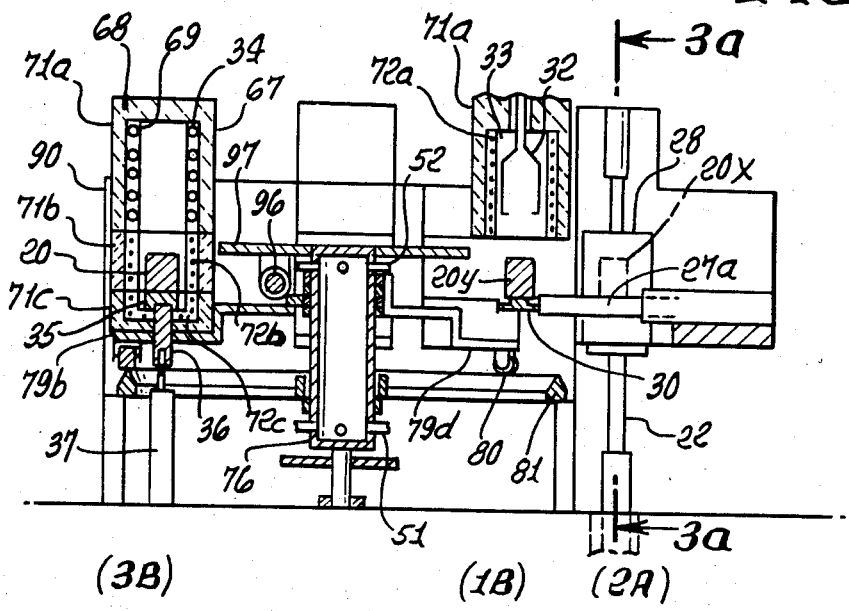
Figure 3A:
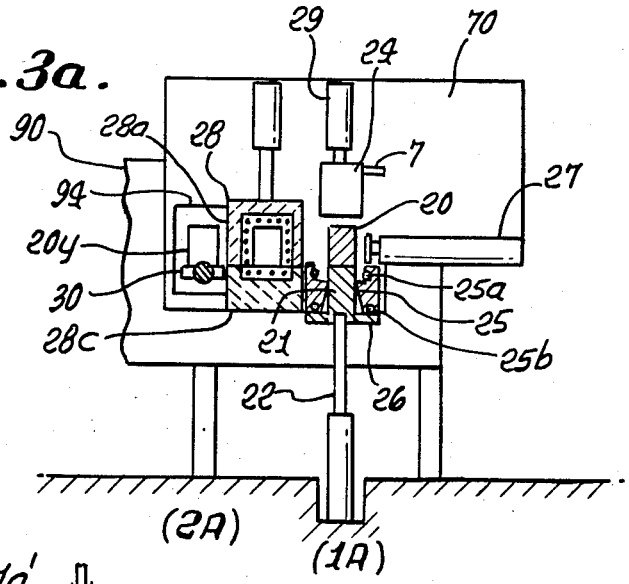

Referring first to FIGS. 1, 3 and 3a associated with stations 1A, 1B, and 3B, charge 20 is lifted on base 21 by ram 22 into position in the entry chamber 70 for transfer from position 1A to 2A. A shell 24 is in place in entry chamber 70 as shown. In the down position, it is sealed by O-ring or other seal 25a at its base as shown. When the charge 20 is lifted into closed shell 24, base 21 also seals the entry port 25 as by engagement against flange 26 and O-ring 25b as shown.

Shell 24 is now evacuated, and purged with a protective atmosphere (usually the same as in the entry chamber, an example being $N_2$). After purging, shell 24 is lifed by ram 29 to allow charge 20 to be moved horizontally to position 2A by ram 27.

FIG. 3a also shows an optional intermediate heating step using an enclosure body 28, the top section 28a of which can be raised to accept charge 20, lowered to heat charge 20, and subsequently raised to allow transfer of charge 20, by push or other means to position 2A, as indicated at 20x.

When charge 20 is preheated with an enclosure body 28, and the cover 28a is raised, charge 20 may be moved by ram 27 to position 2A where it rests momentarily on horizontally movable tray 30. Ram 27a then can be actuated to move charge 20 to position 1B (as shown at 20y), where it can be lifted by tongs 32 into heated chamber 33 for subsequent loading into heated enclosure body lower sections 71b and 71c, after which movable tray 30 is retracted back to its position at 2A.

Suitable seals may be provided at port 94 in the housing 90, and via which radial access is obtained to interior 91, for the charge and the tray 30.

Charge 20 is next rotated to position 2B, in lower sections 71b and 71c of the heated enclosure body 71 as shown in FIG. 2. If charge 20 is to be induction heated, it is lifted into induction heating coil 34, at 2B, as shown. For this purpose, a lifting unit may have a ceramic disc 35 as a support base for the charge 20, and a lifting stem 36 that rides with the heated enclosure body lower sections 71b and 71c. A lifting stem 37 that is located at position 2B rises to fit into stem 36 and moves the charge up into coil 34. If charge 20 is to be radiant heated only, lifting stem 37 is not actuated. When charge 20 is heated to a desired temperature, or when the cycle time requires that charge 20 be moved to the next position, it is lowered back into the heated enclosure body lower sections, and lifting stem 37 is lowered further to the rest position shown in FIG. 3 to allow sections 71*b* and 71*c* to be rotated to their next operation position. The lower sections of the heated enclosure body then are rotated to the next position at station 3B, where the charge may be additionally heated, as described for position 2B, to required temperature, or where the charge may be maintained at a required temperature.

As described above, powder material parts shown as charge 20 which have been preformed by pressing, sintering or other means, are entered into the preheat system at 1A, and are processed through handling and preheat steps 2A, 1B, 2B and 3B, which steps bring charge 20 to the temperature required for consolidation, in a controlled atmosphere environment which protects the part from oxidation or contaminants. Charge 20 then is moved in the heated enclosure body lower sections to position 4B, as shown in FIGS. 1 and 2.

At 4B, tongs 38 are held at a controlled temperature in heated unit 39, which section mates as a top section with the sections 71*b* and 71*c* when they move into place below 39.

When preheated charge 20 is in position 4B below the heated tongs 38, the tongs are opened laterally and moved down along charge 20 until they can close on charge 20 as required to grip the charge for lifting, at which time they close on the charge and lift it into heated unit 39 as shown. The emptied lower sections 71*b* and 71*c* of the heated enclosure body then rotate (index swivel) out from under heated unit 39 and along the circular path in chamber 90 to position 4.5B shown in FIG. 1 (about 45° with the 4 station chamber shown) so that the lower sections 71*b*′ and 71*c*′ of the heated enclosure body 71′ in the assembly chamber 90′ can move radially out from position 2C to 4B by means of rams 85*a* and 85*b*, to receive the charge 20. Just prior to moving heated enclosure body lower sections 71*b*′ and 71*c*′ from 2C and 4B, a predetermined amount of hot refractory grain may be loaded into these sections as in FIG. 2′, to provide a bottom layer of grain to support charge 20. Sections 71*b*′ and 71*c*′ then are moved by rams 85*a* and 85*b* to position 4B, tongs 38 move down into those sections to lower the heated charge 20 onto the support base provided (in this case, hot refractory grain), at which point the tongs open out laterally and are withdrawn back into heated unit 39. Sections 71*b*′ and 71*c*′ of the heated enclosure body then are moved back radially to position 2C to continue the process steps.

As shown in more detail in FIGS. 8 and 9, lower sections 71*b*′ and 71*c*′ are designed to move radially together on roller wheels 40*c* and tracks 41*c* out of the assembly chamber 90′. In the preheat chamber 90, track assembly 42 is held at position 43 unit sections 71*b* and 71*c* of the heated enclosure body 71 in the preheat chamber are moved to position 4.5B. Then track assembly 42 is rolled forward by ram 44 to position 4B to allow sections 71*b*′ and 71*c*′ from the assembly chamber to move to 4B.

When charge 20 has been lowered into sections 71*b*′ and 71*c*′ at position 4B, the sections are returned to position 2C, where a second load of hot refractory grain is poured over the charge so that it is enclosed in the grain.

Sections 71*b*′ and 71*c*′ then are moved by arm 79 to position 3C, where the grain can be packed to required condition for the consolidation step. FIG. 4 shows a typical form of packing plug 45 that can be moved down against the grain and vibrated or tapped or otherwise actuated to pack the grain. The plug may be heated by overhead section 71*a*′ as shown to maintain the temperature of the refractory grain during this step.

After packing the hot grain at position 3C, the lower sections 71*b*′ and 71*c*′ of the heated enclosure body are moved to position 4C, with the grain and its enclosed charge at the required temperature and in a ready condition for transfer to a consolidation die at position 1D.

At station 1D, associated with exit chamber 152 attached to the outside of the assembly chamber wall 90*b*′ in line with 4C radially relative to the central shaft 76′ of the assembly chamber 90′, components are in position as shown in FIG. 2′ to transfer the hot charge 20 from the heated enclosure body section 71*b*′ into the consolidation die 50. A sliding plate 54 is used at station 1D in the same manner as shown in FIG. 7 to provide a movable, gas tight cover for the opening in the bottom of the chamber at 1D that can move out of the way as the consolidation die 50 moves into place, and that will move back to close the opening as the die is moved to the consolidation press. For this transfer, as shown in FIG. 2′, consolidation die 50 is moved on track 55 to the 1D position, with its central cavity 50*a* directly in line with heated top transfer plug 56. As die 50 moves into the 1D position, its top forward edge contacts the front edge of the sliding plate 54 and moves it back, while maintaining a gas seal as required in the opening.

The top surface of plate 54 and of die 50 are in line with the bottom surface of section 71*b*′ of the heated enclosure body, so that section 71*b*′ can move over the top of die 50 supported by roller wheels 40*b* riding on tracks 41*b* and 46 (at 4C and 1D respectively), to provide movement without obstruction and with minimum loss of refractory grain. In consolidation die 50, bottom punch 57 is held in place at the top of the die cavity by shaft 58 and ram 62 until the charge 20 is to be moved into the die. Shaft 58 is centered at its bottom by disc 59 which has a hole 60 through which the shaft can move.

Actual transfer of charge 20 takes place as follows: insulating block 61 is moved out from under plug 56 as by actuator 154; heated enclosure body section 71*b*′ is moved over die 50 with charge 20 and refractory grain 20′ directly in line below plug 56; plug 56 is moved down by actuator 155 to contact grain 20′ which surrounds charge 20; and then plug 56 moves dowm simultaneously with ram 62 to move charge 20 downwardly into die 50. Ram 62 then withdraws below transfer track 55, while plug 56 returns upward to its rest position.

Heated enclosure body section 71*b*′ then moves back over section 71*c*′, while insulating block 61 moves back simultaneously to its position below heated plug 56.

Consolidation die 50 then is moved on track 55 to the press 89 for the consolidation step at 2D, while sliding plate 54 simultaneously moves to close the bottom opening in the chamber at 1D. An actuator for plate 54 is indicated at 157. Plane 175, defined by the top of lower section 71*c*′ and by the top of plate 54, is important as defining key transfer and locating surfaces, as described. A master control for all the actuators, rams, etc. is shown at 158.

Referring now to FIG. 8, an actuating mechanism for the tongs 38 is shown. The upper arm sections 162 of the tong arms 38 are pivotally suspended and held in slot 173 in horizontal plate 172 by upper and lower pins 160 and 161 extending over and under plate 172, whereby the tong arms can move left and right in slot 173; however, the upper arm sections 162 are laterally confined between inner and outer jaws 163 and 164 provided with cams 163*a* and 164*a*, which taper downwardly and laterally. The jaws are moved up and down by a mechanism such as ram 165 connected with jaw legs 163 and 164. The tong arm sections 162 have corresponding inner and outer cams 162*a* and 162*b*, which engage jaw cams 163*a* and 164*a*, whereby when the jaws are displaced downwardly from the position shown in FIG. 8 by ram 165, the tong arms separate in a parallel action, and when the jaws are moved upwardly by ram 165, the tong arms move toward one another in a parallel action. Ram 165 may be controlled by master control 158 described above. Vertical guides for the outer surface of the jaws 164 are shown at 169. An enclosure for the tongs and actuator mechanism appears at 170, and the tongs are raised and lowered within this enclosure by rams 171.

STRAIGHT LINE SYSTEM

In addition to the circular systems already described in FIGS. 1, 1', 2 and 2', straight line systems such as shown in FIGS. 5, 6, 7 and 6A can be used to provide the required movement of charges through process operations, using enclosure bodies 71 for heating the charges, and using enclosure bodies 71' for enclosing the charges in grain and discharging them.

Referring first to FIGS. 5, 6, 7 and 6A apparatus, the charge 20" may be entered as shown in FIG. 5, into an entrance chamber section 8*a* at position 1A, in a manner as previously shown with FIG. 3*a*. Charge 20" is shown in FIGS. 5, 6, 7 and 6A as a pressed powder form 20*a*" and a supporting ceramic plug 20*b*" that are loaded together into chamber 8*a* and carried through the process operations as a unit, so that the powder form will be aligned vertically by the ceramic plug in the central cavity of the heated enclosure body, and can be fully enclosed in refractory grain that may be loaded as one complete portion or in several incremental portions in a single station operation.

Horizontal ram 10, which is held in place on support bed 9 by pivot means at its back end, provides means for moving charge 20" from position 1A to 2A. At position 2A, the charge can be heated in an initial heating operation wherein heating unit 28" is at position 2A rather than between 1A and 2A as shown in FIG. 1. Tongs 11, which are connected to the front end of the piston of ram 10 at swivel points 11*a*, are constructed to grip and release charge 20" by the actuation of rams 12 that also are connected to the front end of the piston of ram 10. Tongs 11 also may be lifted and lowered slightly after they have gripped a charge, by means such as a cam rod 13 positioned below the front end of horizontal ram 10 and transverse to it, using lever arm 13*a* and associated ram 14 to rotate the eccentric cross-section of cam rod 13 through an arc sufficient to raise and lower the front end of ram 10 and tongs 11 a desired amount. Charge 20" then can be gripped, lifted and moved from position 1A to 2A without friction between the charge and the support surfaces.

At position 2A, the overhead heating unit 28*a*" can be lowered over charge 20" for a desired time cycle and then raised so that the charge can be moved to position 1B/4B in the adjoining preheat chamber section 8*b*, using horizontal ram 10' and tongs 11' that function in the same manner as ram 10 and tongs 11, to then lift and move charge 20" from position 2A to 1B/4B.

FIG. 6 shows heated enclosure body lower sections 71*b* and 71*c* on movable support base 66, moved into place at position 1B/4B by horizontal shaft 63 on rollers 82 and track 83, to receive charge 20" for preheating. Horizontal shaft 63, as shown in FIGS. 5 and 7, is movable back and forth in a straight line by actuator 65, through bushing 64, which provides a gas seal to prevent the loss and contamination of protective atmosphere in chamber 8. The shaft 63 typically is hollow, with its inner end closed, but has sealed ports at the inner end that allow services such as gas, water and electricity to be supplied to the heated enclosure body in the chamber without contaminating the chamber atmosphere.

In FIG. 6, the option is shown for loading charge 20" directly from position 2A into the heated enclosure body lower sections 71*b* and 71*c* at position 1B/4B (now 1B in function) by: raising base plug 99 that is movable vertically in enclosure body 71, to the top of 71*b* with lifting stem 100 and lifting ram 101 or similar means; placing charge 20" on base plug 99, and releasing and withdrawing the horizontal transfer means such as tongs 11'; and then lowering charge 20" on base plug 99 into heated enclosure body sections 71*b* and 71*c*. When the piston of ligting ram 101 has been lowered so that it disengages from lifting stem 100, the enclosure body lower sections 71*b* and 71*c* then can be moved from position 1B/4B to position 2B by shaft 63 for further heating of charge 20".

FIG. 7 shows charge 20" raised into the overhead enclosure body section 71*a* at position 2B by means of ram 102 for heating to the required temperature with induction heating coil 34, after which the heated charge can be lowered back into enclosure body lower sections 71*b* and 71*c*, and then moved by shaft 63 back to position 1B/4B, as shown in FIG. 6A.

In FIG. 6A, the option is shown for transferring charge 20" up into enclosure body middle section 71*b*', which has been moved horizontally by ram 85*a*" from station 2C in chamber section 8*c* directly over enclosure body lower sections 71*b* and 71*c* in chamber section 8*b*. Ram 101 is shown ready to raise charge 20" up to a position where the bottom surface of charge 20" is even with the bottom surface of middle section 71*b*', so that when the piston of ram 85*a*" is retracted, charge 20" will be moved by middle section 71*b*' to position 2C, where it can be centered and enclosed in refractory grain as will be described.

Referring to FIG. 5, after charge 20" has been enclosed in refractory grain at position 2C, the grain and charge can be moved through following process operations at positions 3C, 4C and 1D as described previously with the circular system, except that enclosure body lower sections 71*b*' and 71*c*' in this case are moved on suport base 66' and on rollers 82' and tracks 83', in a straight line through stations 1C to 4C by shaft 63' which functions in the same manner as shaft 63 in chamber section 8*b*.

At positions 1C, 2C and 4C, enclosure body middle section 71*b*' can be moved transversely by ram 85*a*" to positions 1C', 4B and 1D respectively, to carry out process operations as in the circular system. To prevent heat loss from the top and bottom sections of the enclosure body in these operations, insulating covers 103 may be used which are associated with the back side of 71*b*′ as shown in FIGS. 6 and 6A. The covers 103 are positioned so that they will move below enclosure body top section 71*a*′ and over bottom section 71*c*′ when middle section 71*b*′ is moved transversely as to station 1B/4B, so as to insulate 71*a*′ and 71*c*′ until middle section 71*b*′ is returned to its normal position.

Insulating covers similar to insulating blocks 61 shown in FIGS. 5, 1′ and 2′ at position 1D, also may be used in place of the top covers 103 and 104 to prevent heat loss from the various 71*a*′ top sections at stations such as 1C, 2C, 3C and 4C, as shaft 63′ moves a single set of enclosure body sections 71*b*′ and 71*c*′ through these stations, and also as ram 85*a*″ moves section 71*b*′ transversely out from these stations. The insulating covers 61 in this case typically would be located alongside stations, 1C, 2C, 3C and 4C in chamber section 8*d*, and would be moved horizontally forward below the surfaces of the heated top sections 71*a*′ wherever section 71*b*′ is not positioned below a top section 71*a*′, and moved back horizontally out of the way wherever section 71*b*′ is moved into place below a top section 71*a*′.

Insulating covers like 103 and 104 as shown in FIGS. 5, 6, and 6A also may be used in circular systems such as in FIGS. 1, 1′, 2 and 2′ to prevent heat loss when the middle section 71*b* or 71*b*′ is moved radially out from between the top and bottom sections of an enclosure body at a station, or when the middle and bottom sections of an enclosure body are moved radially together out from below a top section.

The straight line system described above can be used with one set of enclosure body lower sections 71*b* and 71*c* in the preheat chamber 8*b*, and with one set of lower sections 71*b*′ and 71*c*′ in the grain enclosure chamber section 8*c*. This system also can be used with multiple sets of lower sections in each of the chamber sections for higher production rates or other needs.

The heating and transfer systems already described can be varied to meet the needs for processing different sizes, shapes and types of products, with variations such as follows:

1. A circular system for preheating charges, such as shown in FIGS. 1 and 2, can be attached to a straight line system which has stations such as 1C to 1D as shown in FIG. 5. Alternatively, a straight line system can be used to preheat the charges in the same manner as in stations 1B/4B and 2B shown in FIG. 5, with an attached circular system such as in FIGS. 1′ and 2′ providing the functions of stations 1C to 1D.

2. For production on a continual basis with a circular preheat system as in FIGS. 1 and 2, the number of preheat stations required may be determined approximately by dividing the total time required for heating a charge by the time required for transferring a charge from assembly station 4C through station 2D. An attached circular system for carrying the preheated charges through subsequent stations 1C to 4C, to enclose the charges in ceramic grain, is shown in FIGS. 1′ and 2′. In this attached system, four stations and four sets of enclosure bodies provide efficient operations on a continual basis when a single layer of charge is to be placed in each enclosure body. Where two layers of charges are to be loaded into the enclosure bodies on a continual basis, the circular system can be expanded by adding stations 2C′ and 3C′ after stations 2C and 3C, along with an attached other preheat system at 2C′ to feed preheated charges into the system for the second layer. The same principle can be used for additional charge layers.

3. In circular systems which are used for preheating large charges, especially by induction heating on a continual basis, and in circular systems used for enclosing charges in refractory grain on a continual basis, as in FIGS. 1, 1′, 2 and 2′, the top sections of the enclosure bodies 71 and 71′ normally are located in fixed positions in the top of each chamber, and are spaced equally around the central axis of the chamber on the same radius, to match the spacing of the lower sections of the enclosure bodies which rotate on their supporting radial arms around the central axis. When any one of the lower sections is rotated and lined up with a top section, the remaining lower sections normally will line up in a primary alignment with the remaining top sections; and as one lower body section is rotated sequentially from a position below one top section to the next position, the remaining lower sections follow in the same sequence. Both the top and lower sections of the enclosure body may have secondary actions at a primary position (such as swivelling or radial movement) as required for process operations.

4. When a circular chamber has more enclosure body top sections in fixed station positions than it has lower sections, as for example when only one set of lower sections is used with a plurality of top sections, insulating covers similar to insulating blocks 61 shown in FIGS. 1′ and 2′ at position 1D, and with or without a ram mechanism, may be positioned on radial arms 79′ that are connected to central shaft 76′. The insulating covers are positioned just below those top section surfaces that are not aligned with lower sections 71*b*′ and 71*c*′ of an enclosure body, so that as the low sections of the enclosure body are rotated on their radial arm 79′ to a position below one of the 71*a*′ top sections, the other 71*a*′ top sections are aligned with and insulated by the above described insulating covers.

5. In circular preheating systems similar to that shown in FIGS. 1 and 2, but with the enclosure bodies having an inner cavity shaped in a manner as in FIGS. 10 to 12 or enclosure body 28 in FIG. 3*a* that fits a charge closely for fast, efficient heating by radiation and conduction, the top sections of the enclosure bodies 71 may be constructed to rotate with the lower sections in the circular chamber to provide continual heating of each charge in its enclosure body, with necessary services extended to each top section from the central shaft 76 about which the enclosure bodies rotate. The top and lower sections of the enclosure bodies may rotate together continually in one direction in a circular path, or they may rotate together in one direction for up to 360° and then be brought back to a starting position to start the cycle again in a continual sequence.

Loading and unloading the charges can be accomplished in this system by lifting the top section up from the lower section a sufficient distance, by a hydraulic ram or similar means, as with the enclosure body 28″ shown at position 2A in FIG. 6, to allow the charge to be loaded into or unloaded from the enclosure body lower section, by means similar to the horizontal ram 10′ and tongs 11′ shown in FIGS. 5 and 7, or by similar means.

Loading and unloading the charges also can be accomplished in this system by lifting the top section of the rotating enclosure body a sufficient amount by direct ram lift or similar means to clear the charge, and then moving the top section back horizontally toward the central shaft 76 and in line with radial arm 79, by use of horizontal ram action and rollers and tracks similar to those shown in FIGS. 8 and 9, and as will be described. The lower section of the enclosure body at the end of the radial arm 79 then can be rotated into position below an overhead loading chamber for loading or unloading a charge. Mechanisms also can be used as previously described and as will be described to raise and lower the enclosure body sections and to rotate and swivel them as required to meet the individual cycling requirements for loading and unloading various types of charges.

6. In addition to overhead ram means for lifting and lowering the top section of an enclosure body as already described, FIGS. 8 and 9, and 22–27 show other means for raising and lowering enclosure body sections, to bring them together as required for process operations, and to separate them to allow free horizontal movement of a section or sections at or between process stations, with minimum loss of heat, atmosphere gas and ceramic grain.

FIGS. 8, 9, 22 and 23 show the use of a cam rod mechanism to raise and lower enclosure body sections 71*b*′ and 71*c*′ as required for process operations. In FIG. 23, cam rod 115 is shown supported in groove 84 in radial arm support base 79′, and is positioned transversely below tracks 41*b*′ and 41*c*′ that, as shown in FIGS. 8 and 9, support the enclosure body lower sections through roller wheels 40*b*′ and 40*c*′ attached to the enclosure body sections. Cam rod 115 has an eccentric cross-section, so that when it is rotated through a controlled arc by movement of lever arm 115′ and connecting arm 116, the tracks 41*b*′ and 41*c*′ are raised or lowered, thereby raising or lowering the enclosure body lower sections 71*b*′ and 71*c*′ a typical distance of 0.001″ to 0.010″. Two parallel cam rods can be used to assure uniform lifting and lowering of the tracks and enclosure body at all points, with such rods preferably extending transversely under the ends of the tracks at both sides of the enclosure body. Connecting arm 116 may be actuated by a ram or similar means associated with radial arm 79′, to operate both cam rods 115 simultaneously.

The cam rods 115 can be made with a different eccentric cross-section where they cross under each of tracks 41*b*′ and 41*c*′. so that two separate forward or backward movements of connecting arm 116 will provide actions that: (a) raise the bottom and middle sections simultaneously against the top section; (b) lower the middle and bottom sections simultaneously to separate them from the top section; (c) lower the bottom section further to separate it from the middle section; and (d) raise the bottom section against the middle section. The same movements of enclosure body sections also can be obtained by using cam rods which have the same eccentric cross-section under both the 41*b*′ and 41*c*′ tracks, and providing either a light groove in the radial arm support base 79′ under the bottom surfaces of tracks 41*c*′, or a light relief in the bottom surfaces of tracks 41*b*′ at positions that are over the cam rod, or similar means.

As the tracks 41*b*′ and 41*c*′ are raised and lowered in the above operations, they are held vertical by means such as guide rods 117, which are secured at their bottom ends to radial arm support base 79′, and fit with a sliding fit in holes 117′ in the bottom ends of tracks 41*b*′ and 41*c*′.

FIGS. 24 and 25 show a wedge means instead of cam rods for raising and lowering tracks 41*b*′ and 41*c*′ and thereby enclosure body sections 71*b*′ and 71*c*′ with coordinated movements as described above. With this means, wedge 119 extends transversely under tracks 41*b*′ and 41*c*′ at both sides of the enclosure body, and is seated in a channel 88 in radial arm support base 79′ which has the same bottom surface angle as the wedge angle. Two parallel wedges 119 preferably are used to assure uniform lifting and lowering of the enclosure body sections at all points. Connecting arms 120 are fastened to the ends of wedges 119 and may be actuated to move forward and backward by ram or similar means associated with radial arm support base 79′, to raise and lower tracks 41*b*′ and 41*c*′ and the enclosure body sections they support. Other construction and operations are basically the same as with the cam rod mechanism above.

FIGS. 26 and 27 show a screw means for raising and lowering enclosure body sections 71*b*′ and 71*c*′ with coordinated movements as described above. With this means, screws 123 are positioned in threaded holes in radial arm support base 79′ to contact the ends of the bottom surfaces of tracks 41*b*′ and 41*c*′, with short lever arms 124 attached to the bottom end of the screws below the support base. Connecting arms 125 are attached to the outer ends of lever arms 124 and may be actuated to move forward and backward by ram or similar means associated with radial arm 79′ to raise and lower the enclosure body sections as described above. Other construction and operations are basically the same as with the cam rod mechanism above.

Other conventional lever means can be used for raising and lowering tracks 41*b*′ and 41*c*′, as well as direct ram action from rams associated with radial arm support base 79′ that provide the required vertical movement of the enclosure body sections, with the ram action especially advantageous for vertical movements greater than 0.010″. In addition, the mechanisms described here for raising and lowering enclosure body lower sections carried by a radial arm such as 79′ also are applicable to enclosure body lower sections carried by a support base such as 66 or 66′ in a straight line system as shown in FIGS. 6, 7, and 6A.

7. The lower sections of heated enclosure bodies can be made to provide precise positioning of a charge as it is loaded into the internal cavity of the enclosure body, so that charges can be repetitively enclosed in refractory grain in fixed orientations for later consolidation. This is an important factor in assuring consistent deformation of charges during consolidation, with predictable final dimensions and shapes.

FIGS. 13 and 14 show lower sections 71*b*′ and 41*c*′ of an enclosure body with horizontal alignment rods 127 and vertical alignment rod 128 extending through the enclosure body outer walls 67 and insulation 68 and internal walls 69 to predetermined positions that will align a charge in a central location, indicated at 130 by dotted lines, within the internal cavity of the enclosure body. FIG. 14 also shows a base layer of refractory grain already in place to additionally support the charge as the charge is loaded into the enclosure body from an overhead position. Rods 127 and 128 are moved in and out of the enclosure body cavity by rams 129 or other similar means associated with the enclosure body outer shell 67. When a charge has been lowered into the enclosure body lower sections, typically at station 4B, as in FIGS. 1 and 2, rods 127 and 128 may be moved in to the positions shown in FIGS. 13 and 14 to align the charge, after which refractory grain can be loaded around the charge at station 4B or 2C to enclose the charge and hold it in position for consolidation. Rods 127 and 128 then can be retracted by rams 129 to a position where their front ends are flush with the inner surface of the enclosure body internal wall 69, as shown in the FIG. 17 detail. This retracted position of the rods allows middle section 71*b*′ of the enclosure body to be moved out over a die at station 1D, and allows the grain and enclosed charge to be transferred to the die, without interference from the rods.

FIGS. 15 and 16 show how retractable horizontal rods can be used to both align and support a charge as it is loaded up into the middle section 71*b*′ of an enclosure body, typically at station 4B. In FIG. 16, support base plug 35 is shown raised by lifting stem 36, into middle section 71*b*′ to a position that will centrally locate a preheated charge positioned as indicated at 130 by dotted lines. When a preheated charge has been raised to position 130, horizontal alignment rods 127 may be moved in to a predetermined position as shown to align the charge horizontally. At the same time, horizontal support rods 131 may be moved in under the charge to support the charge vertically. Slots 132 in support base 35, or other similar openings in the support base, can be used to allow rods 131 to move under the charge the amount required to support it. Support base 35 then can be lowered out of the way, after which middle section 71*b*′ can be moved back over the bottom section 71*c*′ at station 2C. The charge then may be enclosed in refractory grain, and rods 127 and 131 retracted to the position shown in FIG. 17 for subsequent operations as already described. The same procedure can be used with rods 127 and 131 when a preheated charge is loaded into middle section 71*b*′ or into lower sections 71*b*′ and 71*c*′ from an overhead position, using tongs as shown in FIG. 2 or other means.

8. The top section of a heated enclosure body also can be made to align a charge as it is loaded into the internal cavity of an enclosure body, particularly where a charge is to be loaded up from a preheat unit into an enclosure body middle section as shown in FIG. 6A. FIGS. 18–21 show how this type of alignment can be accomplished with an enclosure body top section 71*a*″ which: (a) is horizontally movable, typically between stations 2C and 4B; (b) contains vertical alignment rods 48 that are movable vertically by lifting/lowering means such as rams 92 associated with 71*a*″; and (c) replaces stationary top sections 71*a*′ and 71*a* that are shown in FIG. 6A. The top section 71*a*″ moves horizontally on rollers 49 and tracks 47, by means similar to ram 85*a*″ that moves middle section 71*b*′ horizontally.

FIGS. 18 and 19 show enclosure body top section 71*a*″ and middle section 71*b*′ moved to station 4B to pick up a preheated charge 20″ from preheat enclosure body lower sections 71*b* and 71*c* that also have been moved to station 4B below the above sections 71*b*′ and 71*a*″. The heated charge 20*a*″, in this case supported on its own ceramic plug 20*b*″, then is raised by support base 99 and lifting stem 100, as in FIG. 6A, until the bottom of 20*b*″ is even with the bottom of middle section 71*b*′. Vertical alignment rods 48 then are moved down to align the charge in middle section 71*b*′ and to hold it aligned as both sections are moved back to station 2C. FIGS. 20 and 21 show the charge moved to station 2C, and the alignment rods 48 retracted upward into section 71*a*″, with the charge aligned and ready for being enclosed in refractory grain, typically from offset feed hoppers and chutes, as will be described.

The vertical alignment rods 48 can have an eccentric and varied cross section as shown in FIGS. 19 and 21, and can be made to rotate around their longitudinal axes through an arc of approximately 90° as they extend and retract, so that when they are fully down, they provide a close final alignment of the charge in the enclosure body cavity with minimum surface contact and heat loss from the charge, and also provide the clearance needed when they are moved in and out of the enclosure body middle section.

Rods 48 also may be made with bottom end projections 48*a* long enough to move under charge 20*a*″ when rods 48 are rotated, to hold 20*a*″ vertically in a central position in middle section 71*b*′ unit it is enclosed in refractory grain at station 2C or 4B, thereby eliminating the need for ceramic support plug 20*b*″.

9. A charge also may be aligned and enclosed in refractory grain in an enclosure body internal cavity by other means than already described. For instance, if a charge 20*a*″ along with a ceramic support plug 20*b*″ is loaded up into enclosure body middle section 71*b*′, as in FIG. 6A, centering can be accomplished by moving section 71*b*′ back by action of ram 85*a*″ just beyond the center of position 2C so that the charge is centered at 2C, and then moving section 71*b*′ back to its normal centered position below section 71*a*′ so that refractory grain can be loaded in a single operation around the centered charge.

A preheated charge 20*a*″ with ceramic support plug 20*b*″ also can be loaded up into an enclosure body middle section 71*b*′ at station 4B as shown in FIG. 6A, where it can be aligned and supported by horizontal alignment rods 127 and 131 as shown in FIGS. 15 and 16. The preheat enclosure body lower sections 71*b* and 71*c* then can be moved out of the way, so that bottom section 71*c*′ of the assembly enclosure body can be moved in below middle section 71*b*′ to permit the charge to be enclosed in refractory grain in a single grain loading operation at either station 2C or 4B, as will be described.

A preheated charge 20*a*″ with ceramic support plug 20*b*″ also can be processed through a system such as in FIGS. 1, 2, 1′ and 2′, with both the charge components handled simultaneously by overhead tongs, and with the tongs providing final loading and centering of 20*a*″ and 20*b*″ in enclosure body lower sections 71*b*′ and 71*c*′, typically at station 4B. Refractory grain then can be loaded into 71*b*′ and 71*c*′ to enclose the charge in a single grain loading operation either at station 4B by offset feed hoppers and chutes, or at station 2C by direct overhead loading.

A charge 20 also can be placed and aligned in an enclosure body using overhead tongs like those shown in FIG. 2, and with a single or multiple grain loading operation. For this method, after tongs 38 have lifted preheated charge 20 into chamber 39 at station 4B, enclosure body lower sections 71*b*′ and 71*c*′ are moved radially by rams 85*a* and 85*b* from station 2C shown in FIG. 2′ to station 4B shown in FIG. 2. Tongs 38 then lower preheated charge 20 into a suspended position in lower sections 71*b*′ and 71*c*′, after which refractory grain can be loaded from offset feed hoppers and chutes into lower sections 71*b*′ and 71*c*′ at station 4B, using single or multiple loading steps to fully enclose charge 20 in refractory grain. Tongs 38 then may be opened laterally and withdrawn to their overhead position, leaving charge 20 in an aligned position within the grain. Lower sections 71*b*′ and 71*c*′ then can be moved back to station 2C as in FIG. 2' to proceed through following process operations.

Tongs 38 also may be used in another method to place and align a charge in an enclosure body. With this method, enclosure body lower sections 71b' and 71c' are loaded with a refractory grain base layer at either station 2C by direct overhead loading, or at station 4B by offset feed hoppers and chutes. When the lower sections 71b' and 71c' have been moved to station 4B and the refractory grain layer is in place, tongs 38 then can lower preheated charge 20 down onto or into the refractory grain layer to firmly position it in the grain. The tongs then can be opened laterally and withdrawn to their overhead position, after which additional grain can be loaded at station 4B or 2C to fully enclose charge 20 so that it can proceed through following operations as previously described.

10. Enclosure bodies such as 28, 71, and 71' already described will give the most efficient heating and atmosphere protection of a contained charge, as well as controlled positioning of a charge as needed for following process operations, when the internal wall sections in the enclosure bodies are made with internal cavity shapes that closely fit the charge shapes.

FIGS. 10–12 show internal wall sections 31a and 31c that can be used in enclosure body sections like 28a and 28c in FIG. 3a, to rapidly heat an enclosed, shaped charge 19 to a high temperature by radiation and conduction. Internal wall sections such as 31a and 31c typically are made with outside configurations that allow them to be fitted into and held in a fixed position within the insulation 68 of their enclosure body sections, like those wall sections in the top and bottom enclosure body sections 28a and 28c in FIG. 3a. Resistance heating elements 72, in this case embedded in the internal wall sections and electrically insulated from the wall material by ceramic insulationn 75, provide for a high heat input to the walls, and fast heating of the shaped charge 19. The wall preferably is of a high melting point, high thermal conductivity material with a surface that is abrasion resistant and non-reactive and has a low coefficient of friction with the charge materials as they are carried through the process operations. Suitable wall materials include high temperature cobalt and nickel base alloys, refractory metals such as tungsten and molybdenum, metal oxides and carbides, and similar refractory materials and compounds. Molybdenum is a desirable wall material, and the abrasion and reaction resistance of molybdenum and other wall materials can be increased typically with a surface layer of carbide or refractory oxide.

The gas flow inlet 18 shown in FIGS. 10–12 is positioned a feed a high purity protective gas directly into the internal cavity of the internal wall sections to provide a primary protective atmosphere around charge 19 when it is enclosed as shown. Enclosure bodies such as 71, 71' and 28 in FIGS. 2, 2' and 3a respectively and related figures, also are typically constructed to have a primary atmosphere fed to the internal cavity to protect the enclosed charge. Primary atmosphere gases that may be used include argon, helium, hydrogen, nitrogen or other protective gases, used alone or as gas mixtures. These gases are available commercially with very low levels of gaseous impurities such as oxygen, water vapor and other impurity gases which can damage both a powdered material charge and enclosure body components at high temperatures.

When these primary gases are fed into the cavity that encloses a charge, they flow out through the slight gaps between the adjoining surfaces of the internal wall sections, such as between 31a and 31c, into the outer parts of the enclosure body and then into the outer chamber. In these spaces, they act as a secondary atmosphere which effectively protects the primary atmosphere, but which has a somewhat lower purity than the primary atmosphere, because of contamination with impurity gases that leak into the outer chamber or that are released from the insulation and other surfaces in the enclosure body at high temperatures.

The close fit of the internal wall cavity surfaces 31a and 31c to the charge shape, and the close fit of the internal wall sections adjoining surfaces to each other, as well as the presence of a secondary protective atmosphere outside the internal walls, provide specific advantages. They make it possible to protect the charge with a minimum flow of primary atmosphere gas into the cavity to counter the back diffusion of impurity gases from the secondary atmosphere into the cavity, which is economically desirable. In addition, this lower gas flow reduces the amount of adverse reactions that can take place in a charge as it is exposed to the small amounts of impurity gases that normally will be present in the primary atmosphere.

The purity of the secondary atmosphere in enclosure bodies such as 28 in FIG. 3a, and 71 and 71' in FIGS. 2 and 2', can be improved by enclosing the body insulation 68 in a thin sealed shell or shells of solid metal or dense ceramic; entering primary protective atmosphere gas into the shell; and venting the gas outside the enclosure body, so that the primary atmosphere flowing from the internal cavity of the enclosure body will not be contaminated by gases from the insulation. The purity of the secondary atmosphere in the outer chamber also can be maintained at a desired level by exhausting it on a continual basis either to the air outside the chamber, or to a gas purification system in which it can be purified and recycled to be used again as a primary atmosphere gas.

11. Enclosure body internal wall section such as 31a and 31c shown in FIGS. 10–12 may be made with different internal cavity shapes to efficiently heat different charge shapes and either single or multiple charges, but have the same outside configuration and electrical connection means so that they can be conveniently interchanged in the enclosure body to handle different shapes of charges. For internal wall sections such as shown in FIGS. 10–12, the surrounding enclosure body normally would be made in two sections, as in enclosure body 28 in FIG. 3a.

The internal wall sections of an enclosure body also can be made with an internal cavity 69' as shown in enclosure body 71' of FIG. 2', that provides for enclosing a preheated charge in refractory grain, and for transferring the grain and charge to a die. In this case, the internal cavity 69' of enclosure body 71' has a cross-section that matches the die cavity opening, with the enclosure body designed as previously described and as will be described to maintain the temperature of the charge and provide required atmosphere protection, as the charge is carried through process operations. The internal cavity 69' also forms and holds the refractory grain and charge in a controlled configuration that allows convenient transfer of the charge to the die with minimum grain loss or disturbance. Cavity 69' has, for this purpose, an essentially uniform cross-section over its vertical length, but may be tapered slightly outward toward its discharge end to aid in moving the charge out into die cavity 50*a*.

12. Enclosure bodies such as 71 shown in FIGS. 2 and 3, which are used for preheating powder material charges, can be constructed to provide different means for heating charges, including radiation and conduction heating as already described, induction heating, resistance heating, and heating during transfer operations.

For smaller charges that are to be heated by radiation and conduction, including those charges that weigh less than 100 pounds, and where interchangeable internal wall sections such as in FIGS. 10–12 are not used because of product volume, product shape, or other production considerations, the internal cavity of an enclosure body 71 may be made to heat and transfer two or more different charge shapes, but with overall dimensions that provide a compact enclosure of the different shapes. With this construction, there ususally will be some loss of heating efficiency over that obtainable with internal cavities such as in FIGS. 10–12 that closely fit charge shapes, but there also can be compensating advantages from increased operating efficiency and flexibility. Also with this construction, the internal walls of both the top and lower sections of enclosure body 71 normally will be heated as by heating elements like those shown in FIG. 71' of FIG. 4, and the number of enclosure bodies used in a system for preheating charges usually will be determined by production requirements, in a manner as previously described.

Where charges are to be heated by induction heating as at position 2B in FIG. 2, the induction heating coils can be enclosed in the internal walls 69*a* of the enclosure body top section 71*a*, with the internal walls normally being of electrically non-conductive ceramic for this purpose. For charges which are to be heated by direct resistance heating, the internal walls 69*a* of the top section can be constructed with electrical contacts which extend out from the walls and which make electrical contact with the ends of a charge as it is raised into the top section 71*a*, so that electrical current can be passed through the charge to heat it by resistance heating.

The lower sections of the enclosure bodies such as 71 in FIG. 2, which are used for heating and transferring charges, can be constructed as a single rather than a multiple unit, when no separation of the lower sections is required for the process steps, as in the preheat system shown in FIGS. 1 and 2, and where such construction provides advantages such as lower cost, elimination of mechanisms and service connections, and elimination of openings that allow gas and heat loss from the enclosure body.

13. Enclosure bodies that are used for enclosing smaller charges weighing up to about 25 pounds in refractory grain and transferring them through process operations, normally will have both the top and lower sections heated as by electrical heating means, so that the grain and charges are maintained at required temperatures, as well as the tooling in the top sections used in the process operations. Such tooling includes tongs, transfer plugs, packing plugs, feed chutes for refractory grain and similar tooling, as previously described. Some sections of the tooling may be cooled to maintain tooling strength and form during process operations.

With certain smaller charges, where production volume is relatively high, and where the top section of an enclosure body is well insulated, and where the preheated refractory grain and the charge have sufficient heat capacity, the top section and its tooling may not require additional heating means to maintain required charge temperatures during process operations.

Also with certain smaller charges, particularly those of more massive form without substantial internal cavities or thin wall sections, refractory grain can be loaded around a charge that is positioned in an enclosure body, and the grain can be preheated to a lower temperature than the charge temperature, providing that the preheated charge and the heated enclosure body have sufficient heat capacity to maintain required charge temperatures through the following process operations.

The refractory grain can be loaded into an enclosure body as shown in FIG. 2', from feed hoppers located above station 2C, with the grain fed through one or more feed chutes 135 in the enclosure body top section at 2C, and with one or more shutters 136 in a chute 135 moved by means such as ram 137 or similar means, to repetitively control the amount of grain fed to the enclosure body. The feed hoppers for the refractory grain also can be positioned to the side or sides of an enclosure body top section, as shown in FIG. 31, with the feed chutes 135 angled to feed the grain into the lower sections of the enclosure body when the lower sections are moved below the top section in process operations. With this offset grain feeding method, the grain can be loaded into the enclosure body lower sections at station 4B or at 2C, with advantages as previously described for enclosing and positioning the charge with simpler alignment and loading procedures.

14. Enclosure bodies that are used for enclosing and transferring larger charges weighing up to thousands of pounds through process operations, may be heated primarily by the heat supplied by the preheated charge or by the preheated charge and preheated refractory grain. For this purpose, the enclosure body sections should be well insulated and used on a continual basis, to maintain the required internal temperatures through the process operations.

Also with larger charges, especially those of more massive form, and with an enclosure body that is well insulated and continually used, refractory grain can be loaded into the enclosure body at a relatively low temperature or without preheating, if the charge is preheated to have sufficient heat capacity to heat the refractory grain and provide the required internal temperatures in the enclosure body.

15. Enclosure bodies 71 and 71', shown in FIGS. 2, 2' 6, 7 and other related figures, typically are used to heat and transfer powder material charges which are in cold pressed or presintered condition, through process operations which enclose the charges in refractory grain and transfer them to a die for consolidations, as previously described. In addition, such enclosure bodies may be used to heat and transfer powder material charges that are already contained in a refractory material container as they enter the preheat chamber, with the charges enclosed in refractory grain within the container.

When a ceramic container such as a castable alumina container is used, with refractory grain or powder such as carbon, graphite, ceramic or mixtures of such grains or powders enclosing the charge in the container, and with a charge that is electrically conductive, the process operations can be simplified. If an enclosure body system is used like that of FIGS. 1, 2, 1' and 2', the loaded container can be entered at 1A; moved to 2A; transferred to enclosure body 71 at station 1B; and moved to heating station 2B to heat the charge. The container and its heated charge then can be moved to station 4B and transferred to enclosure body 71', so that it can be moved directly to station 4C and transferred to die 50 for consolidation. With this type of container and charge, induction heating can be used at 2B to bring the charge to a high temperature as required for consolidation, with the surrounding grain heated by radiation and conduction from the charge, to a temperature that will maintain the charge temperature through the following process operations. The container in turn will be heated by radiation and conduction from the hot refractory grain, but will normally be at a lower temperature than the charge. If the container and heated charge are transferred rapidly to the consolidation die and promptly pressurized, the heat capacity of the charge and refractory grain, and the insulating characteristics of the refractory container and grain, can maintain the charge at a high temperature for consolidation, and at the same time allow the enclosure body and tooling to be operated at a lower temperature, which usually provides lower construction costs and longer operating life.

Containers also may be made of a refractory material such as carbon or graphite that is electrically conductive, with refractory grain or powder such as carbon, graphite or ceramic, or mixtures of such grains or powders, enclosing the charge in the container. Enclosure body systems as previously described can be used to transfer the loaded container through process operations, and to provide fast induction heating of the container with a high energy input, so that the charge will be heated rapidly by the heat conducted through the refractory grain from the container walls. This method allows the processing at high temperatures of electrically non-conductive powder material charges such as ceramics, as well as conductive material charges, using enclosure bodies and tooling that can be operated at relatively lower temperatures than the container or charge.

In addition to handling the above types of containers, which containers are made to be compactible as the charge is consolidated, the enclosure body system already described can be used to process containers in which the container walls are reusable. For this purpose, the container walls normally will be made of strong, wear-resistant refractory material such as metal oxide or carbide, with the cross-section inside the container walls matching the die cavity cross-section. The container is first loaded with refractory grain and a charge, using a separate refractory material plug at its bottom end if this is required to hold the grain in place. The loaded container can be carried through the heating step at 2B as previously described, and then transferred to station 1D, where the grain and enclosed charge are moved down out of the container and into a die 50 for the following step at 2D. The container then is moved to a station such as 1C, where it may be removed from the enclosure body in a suitable condition for re-use.

16. Enclosure bodies may be used to carry out full process operations in a single main chamber, normally with less flexibility and with lower production capability and efficiency than can be obtained with separate but connected preheat and assembly systems as already described.

FIGS. 28 and 29 show a circular form of single main chamber which is designed to heat and transfer a charge 20 that is enclosed in refractory grain 20' within an outer refractory material container 17. Normally the grain and charge will be loaded into can 17 outside the entrance chamber 70, and entered into chamber 70 at station 1A with a evacuation and atmosphere purging cycle as previously described. After container 17 is evacuated and purged at 1A, shell 24 at 1A is lifted to a position over the container 17, and the container is moved horizontally to station 2A by means such as ram 27. In the meantime, base 16 at 2A has been raised level with the bottom surface 70*a* of entrance chamber 70 by ram 15, so that base 16 can receive container 17 and lower it to a position below the surface of 70*a*. Loading of container 17 into enclosure body 71 can be accomplished by moving middle section 71*b* of the enclosure body over 2A; raising container 17 on base 16 into 71*b*; and then moving 71*b* back to station 1B. Station 1B in this system also may function as heating station 2B as shown, and the container 17 may be raised on base 35 into overhead coils 34 for induction heating, by means of lifting stems 36 and 37. When the charge 20 and the container have been heated to required temperatures, container 17 is lowered back into lower section 71*b*, after which enclosure body sections 71*b* and 71*c* are rotated to station 4C, and container 17 is moved radially outward in section 71*b* over consolidation die 50, where the container is transferred into die 50 by means as previously described, for consolidation at 2D. If more than one set of enclosure body lower sections is used for increased production capability, additional overhead heating chambers can be located at positions such as 3B.

FIGS. 30 and 31 also show a circular form of single main chamber, with the enclosure body sections designed to heat a charge and enclose it in refractory grain, and transfer the grain and charge to a die for consolidation. Charge 20*a* in this case is supported on ceramic plug 20*b*, as it is entered into entrance chamber 70" at station 1A and is moved to 2A and 1B/2B as described previously. The charge may be centered in enclosure body section 71*b*" with transverse alignment rods 127 as in FIGS. 13 and 14 or by other means as already described, so that when 17*b*" is moved to station 1B with the centered charge, charge 20*a* and ceramic plug 20*b* are positioned directly over base plug 106, which is shown in a rest position in enclosure body section 71*c*". The top of plug 106 closely fits the central opening 107 of enclosure body section 71*c*" to prevent grain leakage in later operations, and the top surface of plug 106 is flush with the top surface of 71*c*" when plug 106 is in a rest position for receiving the charge. The centered charge at this point can be raised into the overhead heating unit 34 at station 1B/2B/2C and brought to required temperature, after which it is lowered back into lower sections 71*b*" and 71*c*" where refractory grain is loaded into 71*b*" and 71*c*" to enclose the charge, using offset feed chutes 138 and shutters 136 to load the desired amount of grain. Enclosure body lower sections 71*b*" and 71*c*" then may be rotated to station 3C for grain packing, if required, then to station 4C where the grain and enclosed charge are transferred to the die at 1D, and to 1C for die cleaning, in operations as previously described. If more than one set of enclosure body lower sections is used for increased production capability, additional heating stations such as 3B, shown in dotted lines, can be used in the system, and the grain loading operation can be shifted to station 3B/2C. Also, with more than one set of enclosure body lower sections, the lower sections can be made to swivel approximately 45° in the rotary path by ram 96, which is connected to arm 79 and associated with support plate 97 as previously described. This swivel action permits a secondary operation of the enclosure body lower sections at stations such as 1B and 4C, so that primary process operations can be carried forward at other stations on a steady, continual basis.

When a charge 20 is entered into the single chamber system of FIGS. 30 and 31, it can be positioned as required in section 71*b*″ for full enclosure in refractory grain by means such as shown in FIGS. 32 and 33, using transverse rods 127, vertical rod or rods 133 and rams 129, as described previously. Rod 133 and its ram 129 are shown enclosed in shaft 108, which moves with enclosure body lower section 71*c*″, and may be insulated as shown and water cooled if required. Rod 133 also may be contained in shaft 108 without ram 129, with ram 129 or similar device attached instead to the end of the main ram piston 109, and with ram 109 normally positioned at a grain loading station such as 2C. With the foregoing arrangement, rod 133 can be actuated after piston 109 has engaged and locked to the bottom end of shaft 108 and after the piston of ram 129 also has engaged and locked to the bottom end of rod 133, with such locking action accomplished by pin and slot means or by other standard locking means. In order to prevent refractory grain from binding rod 133 as it moves vertically through hole 106′ in bottom plug 106, the hole can be tapered outwardly from the top as shown. Also, to prevent refractory grain from binding shaft 108 and plug 106 as they move vertically through the central opening in enclosure body bottom section 71*c*″, both the plug walls and the walls of the opening can be tapered as shown to provide required clearance between the walls, and for the discharge of any grain that leaks into the space between them.

In addition to the simplified single main chamber circular system shown in FIGS. 28 to 31 and described above, the straight line system shown in FIGS. 5, 7 and related figures also can be used in simpler forms. FIG. 34 shows a plan view of the interior of a chamber for a simplified straight line system, with adaptability either for heating and transferring a charge that is already enclosed in refractory grain in a container as previously described, using the stations that are shown outlined with solid lines; or for heating a charge and enclosing it in refractory grain and transferring it as previously described, using the stations that are shown in both solid and dotted lines.

Where a charge is already enclosed in a container before it is entered into the system of FIG. 34, it can be entered at station 1A shown in FIG. 34 and transferred to 2A, as previously described for FIGS. 28 and 29, or it can be otherwise entered as has been and will be described. The charge then may be received and heated at station 1B/2B and then transferred to stations 4C and 1D and to the consolidation die, using enclosure body top sections and lower sections and lifting rams like those shown in FIGS. 28 and 29, but with the enclosure body top sections in a straight line or transverse to a straight line as shown in FIG. 34, including a cleaning station at 1C′, and with the lower sections supported on wheels and a track to operate as previously described in the same manner as the related operations of FIG. 5.

Where a charge that is not enclosed in a container is to be entered into the straight line system of FIG. 34, it may be entered and transferred to station 2A as already described for FIGS. 30 and 31, or it can be otherwise entered as has been and will be described. The charge then may be received and heated at station 1B/2B, enclosed in refractory grain at station 1B/2B or at 2C, and then transferred through stations 3C, 4C, and 1D to the consolidation die, using enclosure body top sections and lower sections and lifting rams like those shown in FIGS. 30 and 31, including a 1C′ top section, but with the enclosure body top sections in a straight line or transverse to a straight line as shown in FIG. 34, and with the lower sections supported on wheels and a track to operate as previously described in the same manner as the related operations of FIG. 5.

17. Enclosure bodies, if they are to be used effectively for heating and transferring powder material charges in a production operation, require a fast and complete purging of air from the porosity in the charges before the charges are entered into the enclosure body chamber. One means of accomplishing this is shown in FIG. 3*a* at station 1A, where the charge is entered into entry shell 24 and evacuated and purged with the chamber atmosphere before the shell is lifted and the charge transferred to an enclosure body as previously described. In FIG. 3*a*, the shell 24 is shown with a configuration which closely fits charge 20 and base 21, to permit the fast, complete evacuation and purging of charge 20 through port 7, with O-rings 25*a* and 25*b* providing a gas seal at the shell base.

Shell 24 and base 21 also can be made so that a variety of charge shapes and sizes can be entered into the entrance chamber with high efficiency, by using interchangeable split matrix sets within shell 24. Each set is made of a solid material such as rubber, urethane, plastic, metal or other solid material, with a split internal cavity or cavities to fit one or more charge shapes. The lower matrix section of the set typically is associated with the top of base 21, while the top matrix section fits into and is associated with shell 24, so that as the shell is lifted by means such as ram 29, a charge can be loaded into the lower matrix section, and as the shell is lowered and closed, the charge fits closely in the matrix cavity, where it can be evacuated and purged with a fast cycle.

18. The lifting tong mechanism shown in FIG. 8 and described previously can be used in a variety of forms to handle small to very large products in cylindrical shapes, rectilinear shapes, long thin shapes, hollow shapes and other shapes. To accomplish this, the tongs may have two or more opposing arms such as arms 38, which are positioned to fit around a product shape, and are acutated at their upper ends 162 as by jaws 163 and 164 and means as already described, to firmly hold a predetermined product shape or shapes, and to lift such shapes and lower them and release them as required for process operations. The tong arms may be actuated by a single jaw set or by multiple jaw sets, as required for various product shapes.

The tong arms may be used to grip a shape from the outside, and also can be used to grip a shape from the inside if the shape is hollow or has a suitable internal cavity. The lower parts of the tong arms also can be made conveniently replaceable or adjustable to provide for handling various sizes and shapes of product forms with a single form of tong mechanism at the tong's upper ends.

A tong arm such as 38 may be a single arm extending down from jaws 163 and 164 to grip a part. A tong arm also may have a single upper end 162 that is actuated as by jaws 163 and 164, with a lower end of two or more separate associated arm sections, to give a multiple arm holding action with a single upper arm.

19. The entry of a charge into an entrance chamber such as 70 in FIG. 1 or 8*a* in FIG. 5, can be simplified by providing the function of station 1A at station 2A, and eliminating the separate 1A station. With this arrangement, shell 24 and base 21 may be used at station 2A to enter, evacuate and purge a charge 20 as already described. After charge 20 has been purged and shell 24 lifted, charge 20 then can be moved from station 2A to 1B by a horizontal push ram such as 27*a* shown in FIG. 1, or by a horizontal gripping ram such as 10'/11' shown in FIG. 5, where charge 20 can be loaded into an enclosure body for further processing.

Also, shell 24 can be made so that it can be swivelled or moved horizontally out of the way after it has been lifted above the purged charge, after which charge 20 then can be transferred from station 2A to 1B using a horizontal movable enclosure body top section like that shown in FIGS. 18 to 21, which can move between stations 1B and 2A, but which has an enclosed tong mechanism such as in FIG. 8 the alignment mechanism shown in FIGS. 18 to 21, to provide the required charge transfer operations.

20. The heating and transfer systems shown in FIGS. 1', 2', 5 and 7 and related figures provide for moving consolidation die 50 into place at station 1D with the bottom punch raised level with the top of the die. This helps to prevent atmosphere contamination of the chamber interior as the die moves into place at 1D. It also provides a level surface that allows a grain-enclosed charge 20 to be moved horizontally in enclosure body middle section 71*b'* over punch 57, and then lowered into the die cavity between transfer plug 56 and punch 57.

A simple means of holding punch 57 at the top of a die as the die moves to station 1D, is to provide a punch which will hold itself in place at the top of the die cavity by friction, but which will move down under light pressure when the charge is moved down into the die cavity by means such as transfer plug 56. The necessary holding friction can be supplied by the fit of the punch cross-section in the die or in the die liner, or by a side pressure device such as a spring loaded pin in the side of the punch, or by similar means. In this case, punch 57 may have a simple flat bottom surface, and the lifting ram 62, shaft 58 and guide disc 59 shown in FIGS. 2' and 7 may not be required.

Punch 57 also may be held at the top of the die by shaft 58 as the die is moved to station 1D, with shaft 58 made long enough to hold punch 57 level with the top of the die when the bottom end of shaft 58 rides on a solid center section of track 55. At station 1D, track 55 can be made with an opening for the piston of ram 62, which piston in the raised position would have its top surface level with the top surface of track 55. When die 50 is moved to station 1D and the grain-enclosed charge 20 is positioned over punch 57, the piston of ram 62 is lowered until punch 57 is at a bottom position in the die cavity and shaft 58 is withdrawn below track 55. Guide disc 59 with central hole 60 normally will be used at the bottom of the die cavity with this method, to hold the bottom end of shaft 58 centered as it is moved to station 1D over ram 62.

Ram 62 also may be made to ride below track 55 and die 50 from a position outside station 1D to station 1D, with both the die and the ram moving together so that the piston of ram 62 is held aligned with the center of die cavity 50*a*. In this arrangement, ram 62 would engage with die 50 below the die and outside the station 1D position, at which point the piston of ram 62 is actuated to raise punch 57 to the top of the die. As the die and ram move together to station 1D, punch 57 is held at the top of the die by ram 62. At station 1D, after a grain-enclosed charge 20 is moved over punch 57, the punch is lowered with charge 20 into the die, using ram 62, and the piston of ram 62 is withdrawn below track 55 to allow the die and its enclosed charge to be moved to station 2D for the consolidation step.

Disc 59 may be used as described above to primarily center a shaft 58 or a piston of a ram 62, in a die cavity such as 50*a*. Disc 59 with central hole 60 can also be made with a larger cross-section than the die cavity, and fitted into a counterbore recess in the bottom of the die, to provide a lower unit pressure transmitted to the press bed during consolidation, as well as centering of the shaft used to lift and lower punch 57.

21. Enclosure body sections which are constructed to rotate in chambers such as 90 and 90' in FIGS. 1, 2, 1' and 2' normally require services such as gas, electricity, water, etc. for their operation. Such services can be supplied to the rotating enclosure body sections through a central shaft 76 or 76' as shown in FIGS. 2 and 2'. In these figures, the central shaft is shown entered into the chamber through a gas seal opening in the bottom of the chamber, with the top end of the shaft closed; with the enclosure body services entered into the shaft outside the chamber at its lower end section through ports 51; and with the services going to the rotating enclosure body sections through gas seal ports 52 in the upper section of the shaft.

The above services also can be supplied to rotating enclosure body sections using a central shaft which extends through a gas seal opening at the top of the chamber, as shown in FIGS. 29 and 31. Services for the rotating enclosure body sections may be entered into this type of shaft at the top end of the shaft outside the chamber, through ports 53, with the services going to the rotating enclosure body sections through gas seal ports 52 in the central section of the shaft. This arrangement allows the entry point for the services to the shaft to be separated from the shaft drive mechanism, and gives better accessibility for operating and maintaining the services.

I claim:

1. Apparatus for heating powder material charges to high temperatures at a fast rate, and for moving said charges through process operations, and for maintaining the temperatures of preheated charges and protecting the charges against contamination as they are moved through process operations, which includes: a charge enclosing heated enclosure body having two or more separate sections; an internal wall in the enclosure body sections that has an internal cavity having a configuration shaped to hold a desired charge configuration; heating means for the internal cavity wall to heat it to desired temperature; the body being openable to receive a charge or allow transfer to a next step; the body being closable to enclose the charge; the body sections being movable horizontally and vertically as required to move the charge and carry out process operations; an internal protective atmosphere around the charge; the body having associated interior insulation to reduce heat loss to the outside surfaces and allow close temperature control; and mechanisms to open and close and move the heated body sections to allow receiving, holding and transferring of the charge, the internal cavity walls of a lower separable section or sections defined by the body being heated separately from an upper section or sections defined by the body, a top section of the heated enclosure body being held in a fixed position and adapted either to carry out a processing operation or to maintain the top of the charge at a desired temperature; and in which the lower separable section or sections of the heated enclosure body is movable through operational steps that allow the charge to be received, processed, and transferred as required, while protecting the charge against atmospheric or other contamination; and adapted for required control of charge temperatures; and for maintaining the charge in a desired orientation, and wherein each separable section of the heated enclosure body has its own container shell which carries insulation, an internal cavity wall which is heated, and other internal parts of the section; provides for feeding services such as gas, electricity and water to the internal parts of the section through gas-tight seals and lines; and provides mating surfaces and alignment means with adjoining sections; holds internal parts of the section in a stable configuration; provides for precise positioning of the body section in each of multiple process steps; and provides a close enough fit with an adjoining section or sections to maintain a high purity atmosphere inside the internal cavity, and to minimize heat loss from the internal cavity, and including an outer chamber in which the heated enclosure body sections are enclosed, which outer chamber is gas tight and contains a protective atmosphere; and the outer chamber is constructed to allow the body sections to be moved through process steps inside the outer chamber with minimum or no exposure to external air, and wherein the charge unloading chamber is constructed with a sliding bottom plate and with gas sealing means that maintains a gas seal between the chamber and the sliding plate, and said plate is movable out from under the chamber as a consolidation die moves in to take its place, in a manner such that the top section of said die maintains the gas seal, and the top surface of the die is positioned in a plane and at a location where a charge can be unloaded into the die cavity from a heated enclosure body, and including said sliding bottom plate and sealing means.

2. Apparatus for heating powder material charges to high temperatures at a fast rate, and for moving said charges through process operations, and for maintaining the temperatures of preheated charges and protecting the charges against contamination as they are moved through process operations, which includes: a charge enclosing heated enclosure body having two or more separate sections; an internal wall in the enclosure body sections that has an internal cavity having a configuration shaped to hold a desired charge configuration; heating means for the internal cavity wall to heat it to desired temperature; the body being openable to receive a charge or allow transfer to a next step, the body being closable to enclose the charge; the body sections being movable horizontally and vertically as required to move the charge and carry out process operations; an internal protective atmosphere around the charge; the body having associated interior insulation to reduce heat loss to the outside surfaces and allow close temperature control; and mechanisms to open and close and move the heated body sections to allow receiving, holding and transferring of the charge, the internal cavity walls of a lower separable section or sections defined by the body being heated separately from an upper section or sections defined by the body, a top section of the heated enclosure body being held in a fixed position and adapted either to carry out a processing operation or to maintain the top of the charge at a desired temperature; and in which the lower separable section or sections of the heated enclosure body is movable through operational steps that allow the charge to be received, processed and transferred as required, while protecting the charge against atmospheric or other contamination; and adapted for required control of charge temperatures; and for maintaining the charge in a desired orientation, and wherein charge materials are discharged from the heated enclosure body by raising or lowering the charge materials out of the middle section when it is moved into a position for unloading, and means for so raising or lowering the charge materials, and including means to support the bottom punch of a consolidation die at the top of the die and level with the top die surface as the die is moved into place at the bottom of an unloading chamber, and means whereby a transfer plug above the die can move a charge out of an enclosure body middle section and into the die, with the charge supported at its bottom during the transfer by the bottom punch, and including said transfer plug.

3. Apparatus for heating powder material charges to high temperatures at a fast rate, and for moving said charges through process operations, and for maintaining the temperatures of preheated charges and protecting the charges against contamination as they are moved through process operations, which includes: a charge enclosing heated enclosure body having two or more separate sections; an internal wall in the enclosure body sections that has an internal cavity having a configuration shaped to hold a desired charged configuration; heating means for the internal cavity wall to heat it to desired temperature; the body being openable to receive a charge or allow transfer to a next step; the body being closable to enclose the charge; the body sections being movable horizontally and vertically as required to move the charge and carry out process operations; an internal protective atmosphere around the the charge; the body having associated interior insulation to reduce heat loss to the outside surfaces and allow close temperature control; and mechanisms to open and close and move the heated body sections to allow receiving, holding and transferring of the charge, the internal walls of a lower separable section defined by the body being heated separately from an upper section defined by the body, a top section of the body held in relatively fixed position, and a lower section of the body movable to allow the charge to be received, processed and transferred and to maintain the charge in a desired orientation, means for raising or lowering charge materials out of a body middle section moved into a position for unloading, there being a charge unloading chamber constructed with a sliding bottom plate and with gas sealing means that maintains a gas seal between the chamber and the sliding plate, and said plate being movable out from under the chamber as a consolidation die moves in to take its place, in a manner such that the top section of said die maintains the gas seal, and the top surface of the die is positioned in a plane and at a location where a charge can be unloaded into the die cavity from a heated enclosure body, and including said sliding bottom plate and sealing means.

* * * * *